US006257449B1

(12) United States Patent
Baerenwald

(10) Patent No.: US 6,257,449 B1
(45) Date of Patent: Jul. 10, 2001

(54) RECLOSABLE PACKAGE FITMENT HAVING REAR INTRUSION AND FRONT SPOUT LIFT

(75) Inventor: Philip M. Baerenwald, Rockton, IL (US)

(73) Assignee: J. L. Clark, Rockford, IL (US)

( * ) Notice: Subject to any disclaimer, the term of this patent is extended or adjusted under 35 U.S.C. 154(b) by 0 days.

(21) Appl. No.: 09/393,666

(22) Filed: Sep. 10, 1999

Related U.S. Application Data

(60) Provisional application No. 60/099,986, filed on Sep. 11, 1998.

(51) Int. Cl.[7] ..... B67D 5/00; B67C 11/00

(52) U.S. Cl. ..... 222/83; 222/461; 222/544; 229/204; 220/267

(58) Field of Search ..... 222/80, 81, 83, 222/461, 462, 544; 229/204, 125.15; 220/267

(56) References Cited

U.S. PATENT DOCUMENTS

| | | | | |
|---|---|---|---|---|
| 4,216,880 | * | 8/1980 | Drelichowski | 222/83 |
| 4,915,290 | | 4/1990 | Robichaud et al. | 229/125.08 |
| 4,934,590 | | 6/1990 | Robichaud et al. | 229/125.09 |
| 5,101,999 | | 4/1992 | Robichaud et al. | 220/258 |
| 5,799,840 | * | 9/1998 | Mogard | 229/125.15 X |
| 5,806,757 | | 9/1998 | Per et al. | 229/204 |
| 5,875,959 | | 3/1999 | Weiteder et al. | 229/125.15 |
| 5,947,316 | | 9/1999 | Guillonnet | 220/267 |
| 6,003,712 | * | 12/1999 | Mogard et al. | 229/125.15 X |

FOREIGN PATENT DOCUMENTS

| | | | |
|---|---|---|---|
| 4409947 | 9/1995 | (DE) | B65D/5/74 |
| 19635087 | 10/1997 | (DE) | B65D/5/74 |
| WO98/33714 | 8/1998 | (WO) | B65D/5/74 |
| WO99/39984 | 8/1999 | (WO) | B65D/5/74 |

* cited by examiner

*Primary Examiner*—Lesley D. Morris
(74) *Attorney, Agent, or Firm*—Leydig Voit & Mayer, Ltd.

(57) ABSTRACT

A reclosable fitment for a paperboard package having rear intrusion, anti-finger intrusion protection, and a raised spout to more naturally and directly allow the liquid within the container to be dispensed. The present invention provides a two piece fitment or closure having a base which is adapted to be attached about a scored area on a paperboard package. A lever is pivotally attached to the base and includes a rear portion which is adapted to open the scored area at a rear portion thereof. The rear portion is forced downwardly into the container by lifting upwardly on the forward portion of the lever. The forward portion of the lever has a built-in pouring spout which when placed into the open position forms a natural spout elevated away from the base to allow the liquid to more naturally and accurately be directed away from the package. A cover can be pivotally attached to the base to protect the lever from contaminates, and to automatically open the package upon lifting the cover away from the base.

22 Claims, 20 Drawing Sheets

RECLOSABLE PACKAGE FITMENT HAVING REAR INTRUSION AND FRONT SPOUT LIFT

CROSS-REFERENCE TO RELATED APPLICATION

This application claims the priority benefit under 35 U.S.C. § 119(e) of U.S. patent application Ser. No. 60/099,986, filed on Sep. 11, 1998.

FIELD OF THE INVENTION

The present invention generally relates to containers for liquid, and more particularly relates to closures or fitments for such containers.

BACKGROUND OF THE INVENTION

Many goods today are sold in paperboard packages, wherein the paperboard is folded into a box like configuration, and provided with a non-porous lining to prevent leakage of the liquid from the package. A common example is provided in the form of the currently popular juice boxes wherein orange juice and the like can be provided in the package in a portable and easily accessible manner. In addition, many types of condiments and sauces can be provided in such packages and are particularly popular in foreign countries, and restaurant and cafeteria facilities wherein the goods are not sold through retail outlets.

With most such paperboard packages, a closure or fitment, typically plastic, is attached to the package about a scored or perforated area in the paperboard. The fitment is provided to allow a user to easily open the package and allow the contents of the package to be poured therefrom. Commonly, the fitment is provided with a lever arm which is hinged to a base of the closure and which can be downwardly depressed into the package. Such packages can often lead to finger intrusion which can contaminate the contents of the package, and result in an unsanitary mess to the consumer. Recent closure and fitment designs therefore have been directed to providing a mechanism by which the package can be opened, but limits finger intrusion. Currently pending U.S. Provisional Patent Application Nos. 60/073,897, and 60/074,882, which are now abandoned and are directed to such apparatus, the disclosures of which are expressly incorporated by reference herein.

In addition to providing a mechanism by which the package can be opened, such closures or fitments typically have a built-in pouring spout raised slightly above the surface or edge of the container to direct the liquid as it is being dispensed through the opening created by the fitment. However, such pour spouts are typically provided relatively close to the edge of the container and do not direct the liquid away from the package in a well defined, controllable, manner. Additionally, the tongue of the fitment which opens the package can interfere with the dispensing of liquid as the package is tilted forward and the liquid acts against the underside of the closure tongue.

Simply providing a raised spout on the outer surface of the container is not a viable solution in that it would add additional expense to the package and be susceptible to breakage of the spout from the container during shipping and handling. Furthermore, such packages typically require some form of tamper evidence to ensure that by the time the container is actually purchased and ready for use by the consumer, the consumer is provided with a level of security that the contents of the package have not been altered.

Moreover, with many known fitments, in addition to a base having a lever which is pivotally attached thereto, a cover is also pivotally attached to the base. The cover initially covers the base and lever and must be hinged away from the base to gain access to the lever. The process of opening packages using such a fitment entails at least two steps, wherein as a first step, the cover is hinged away from the base, and as a second step, the user downwardly depresses the lever into the package. After use, the lever remains within the package, and the cover is hinged back to the base for closure purposes. Still further types of closures require three steps wherein the cover and a built-in pour spout are provided in the same plane as the lever when the fitment is initially provided. The cover and built-in pouring spout are initially pivoted about a base which causes the lever to penetrate the package. After approximately 180 degrees of rotation, the pour spout attaches to a front portion of the base to lock it in place. The cover is then pivoted back away from the pour spout to open the fitment.

While such types of fitments are functional, the multiple steps involved are time consuming, and are often viewed as a nuisance or cumbersome to the user. It would therefore be advantageous if a package fitment were to be provided wherein the cover can be pivoted away from the base and the package can be opened in one simple step.

SUMMARY OF THE INVENTION

It is therefore an objective of the present invention to provide a fitment for paperboard package wherein a cover can be pivoted away from the base of the fitment and the package can be opened in one step.

It is another objective of the present invention to provide a fitment for a paperboard package which has rear intrusion and a built-in frontal pour spout.

It is another objective of the present invention to provide such a fitment with improved finger intrusion protection.

It is another objective of the present invention to provide a fitment for a paperboard package having a pour spout which is substantially raised above the edge of the container to provide a more natural and directed pouring action.

It is still a further object of the present invention to provide a fitment for a paperboard package having a mechanism to protect the fitment from contaminate intrusion, as well as serving as tamper evidence.

It is still another object of the present invention to provide a mechanism to seal the pour spout against the base of the fitment to avoid dual stream output.

It is yet another object of the present invention to positively maintain the pour spout lever in the open position to prevent the liquid from forcing the fitment into a closed position when acting against an underside of the pour spout lever.

It is still another object of the present invention to provide a fitment wherein the user directs an upward force against the fitment, away from the package, to open the package and thereby avoids finger intrusion.

It is a feature of the present invention to provide, in a preferred embodiment, a closure for a container of dispensable fluid including a base and a lever pivotally attached to the base. The base is adapted to be secured adjacent a pouring lip of a container and has an opening adapted to be disposed proximate a scored area of the container. The lever includes a puncturing end and a pour spout end, with the spout end being proximate the container pouring lip, and the lever being adapted to move between a storage position wherein the lever is substantially parallel to the base, and a pouring position wherein the lever is orthogonal to the base. The spout end is displaced away from the container and the puncturing end is displaced into the container through the scored area when the lever is in the pouring position.

It is another feature of the present invention to provide a closure having a base, a lever pivotally attached to the base, and a cover pivotally attached to the base. The cover serves to protect the closure from contaminate intrusion, and automatically open the closure upon pivotal motion of the cover.

It is another feature of the present invention to provide a closure having a base, a lever pivotally attached to the base, and a cover pivotally attached to the base, wherein the lever extends past the front of the cover. The force used by the user to open the package therefore is directed against the bottom side of the lever which in turn separates the cover from the base. The user then continues to direct force against the lever until such time that the lever locks in place to allow the user to continue to apply force against the cover to move it to its fully opened position.

These and other objects and features of the invention will become more apparent from the following detailed description when taken in conjunction with the accompanying drawings.

Figure 1:
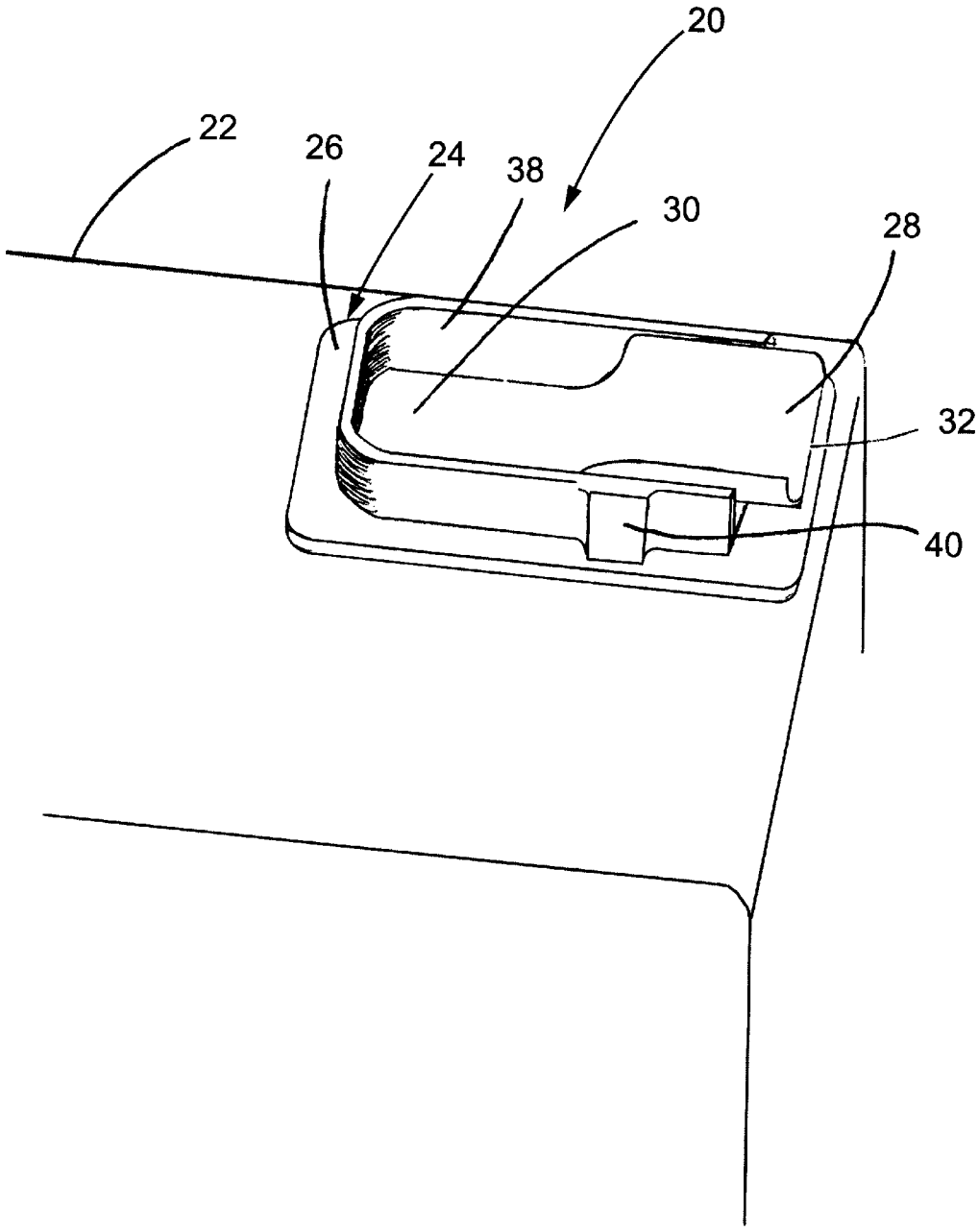
FIG. 1 is a perspective view of a preferred embodiment of the present invention including the fitment in a closed position on paperboard package.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
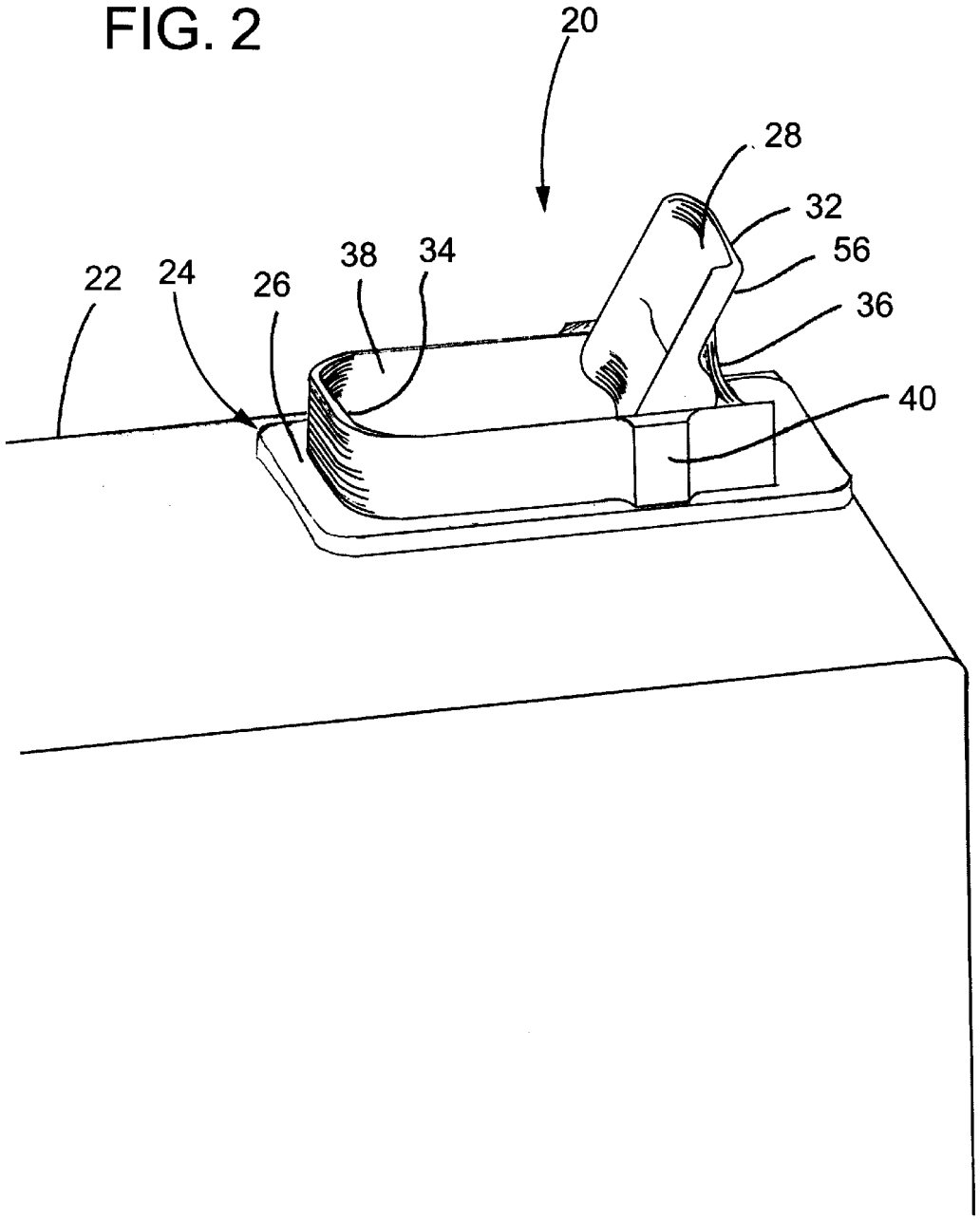
FIG. 2 is a perspective view of a preferred embodiment of the present invention including the fitment in a open position on a paperboard package.

Referring now to the drawings, and with particular reference to FIG. 1, a preferred embodiment of the present invention is generally depicted as fitment 20. Fitment 20 is secured to paperboard package 22 over a scored or perforated area of the paperboard package (not shown). By way of overview, it can be seen by one of ordinary skill in the art that fitment 20 includes a base 24 which is adapted to be adhesively bonded to paperboard package 22 about flange 26, and a lever 28 which is pivotally attached to base 24. Upon lever 28 being pivoted, rear portion 30 of lever 28 is depressed into package 22 through the scored area, (not shown) while forward portion 32 is elevated away from the base and is orthogonal thereto, as best shown in the open position of FIG. 2. While in the preferred embodiment, lever 28 is disposed relative to base 24 about an angle of approximately 60 degrees in the open position, it is to be understood that multiple angular dispositions can be achieved in the open position.

Figure 3:
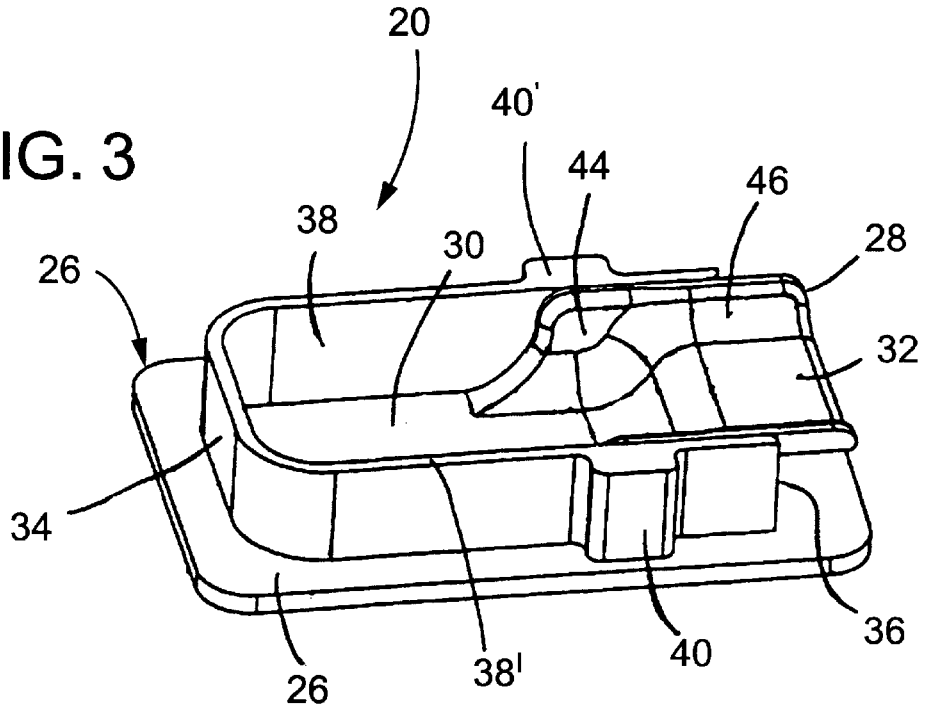
FIG. 3 is a perspective view of preferred embodiment of the fitment in a closed position.
Figure 4:
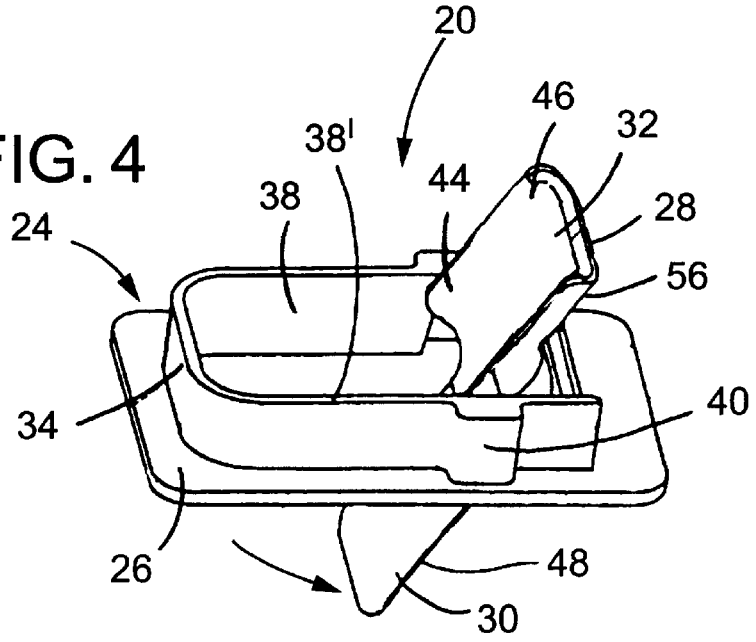
FIG. 4 is a perspective view of a preferred embodiment of the fitment in an open position.
Figure 7:
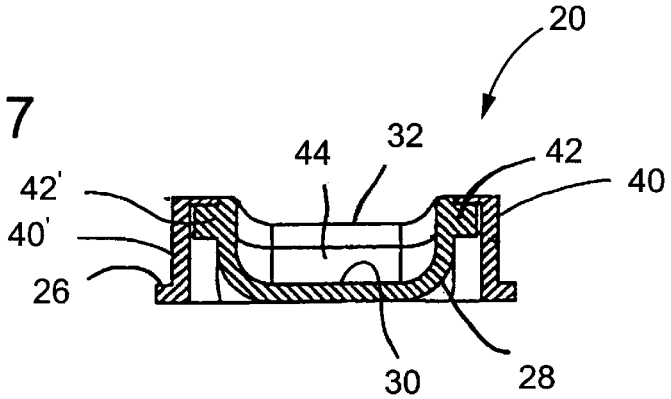
FIG. 7 is a sectional view of FIG. 5 taken along line 7—7.

In more specific detail, fitment 20 is also shown in FIGS. 3 and 4, in the closed and open positions, respectively. Base 24 includes in addition to flange 26, raised wall 34 having open end 36, and opposing side walls 38, 38'. Side walls 38, 38' include sockets 40, 40' (see FIG. 7) which are adapted to receive arms 42, 42' of lever 28, as will be discussed in further detail herein. In the preferred embodiment of the present invention, base 24 is manufactured from a single molded piece of plastic, but the invention is intended to cover multiple materials and mechanisms for manufacturing base 24.

Figure 5:
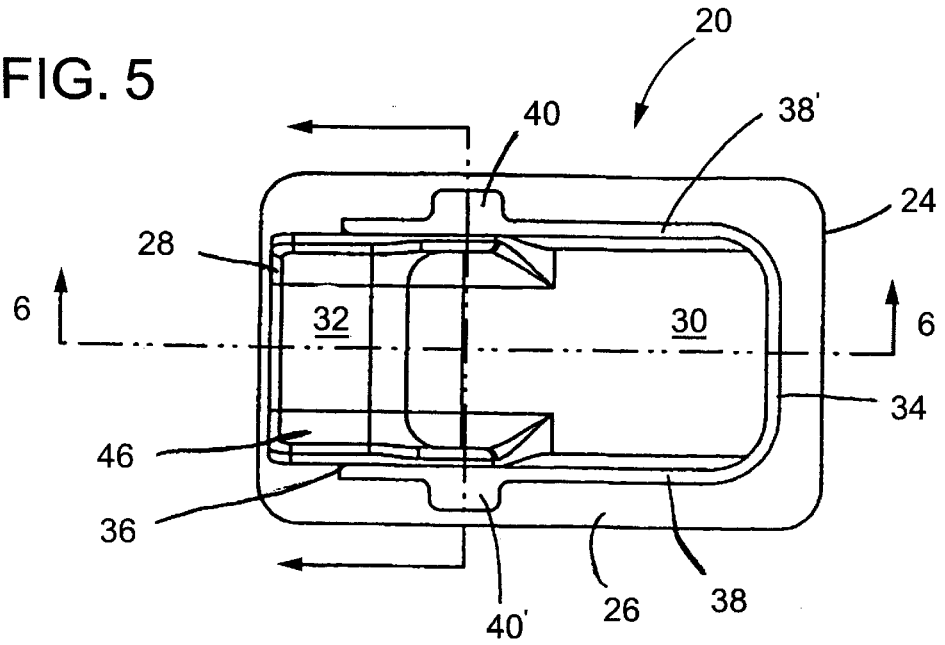
FIG. 5 is a top view of the fitment in a closed position.

Lever 28, as indicated above, includes a rear portion 30 and a forward portion 32. As can readily be seen from the figures, particularly FIGS. 5 and 6, rear portion 30 is substantially lower than forward portion 32 and includes a transition zone 44. It is forward portion 32 which serves as the pour spout for the fitment 20 to more naturally and orderly direct the contents of the container through fitment 20. Forward portion 32 includes channel walls 46 raised above forward portion 32. Proximate transition zone 44, arms 42, 42' laterally extend to sufficiently engage sockets 40, 40' of the base 24 and thereby allow lever 28 to pivot relative to base 24 when moving from the closed position shown in FIG. 3, to the open position shown in FIG. 4. While not depicted, it is to be understood that the underside 48 of rear portion 30 could include a number of intrusion enhancing devices to more easily facilitate puncturing and slicing through the perforated or scored area of the paperboard package 22.

Figure 6:
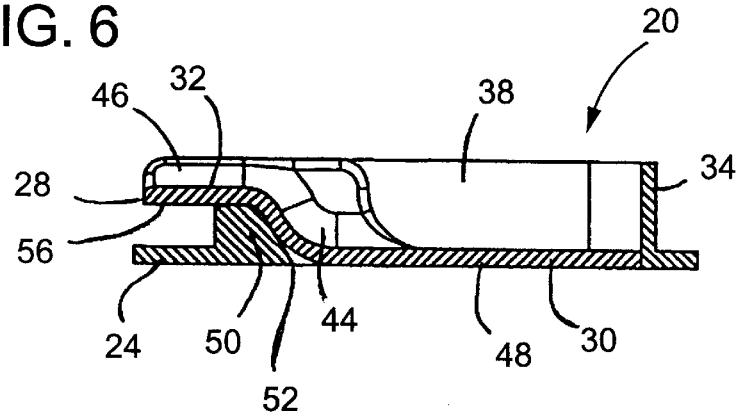
FIG. 6 is a sectional view of FIG. 5 taken along line 6—6.
Figure 8:
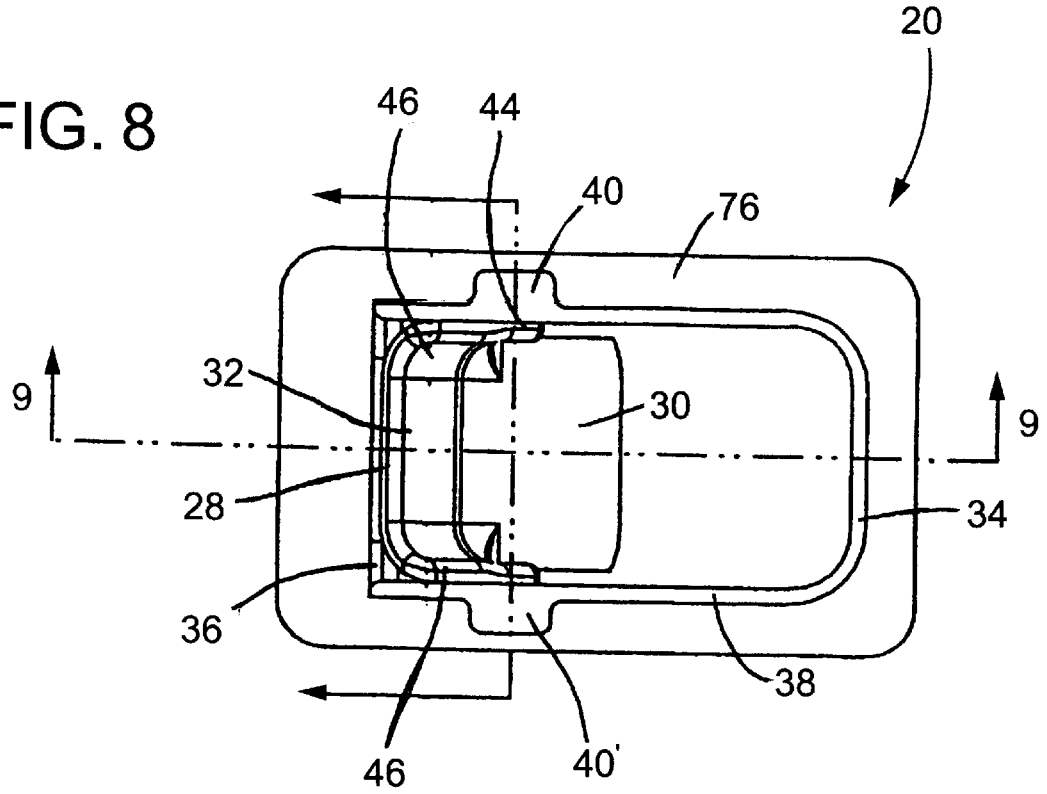
FIG. 8 is a top view of the fitment in an open position.
Figure 9:
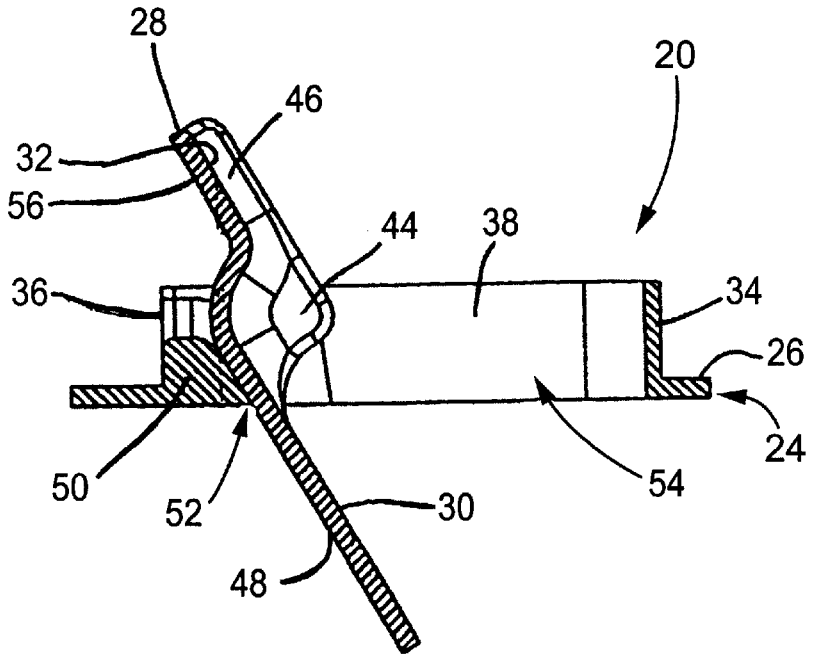
FIG. 9 is a sectional view of FIG. 8 taken along line 9—9.
Figure 10:
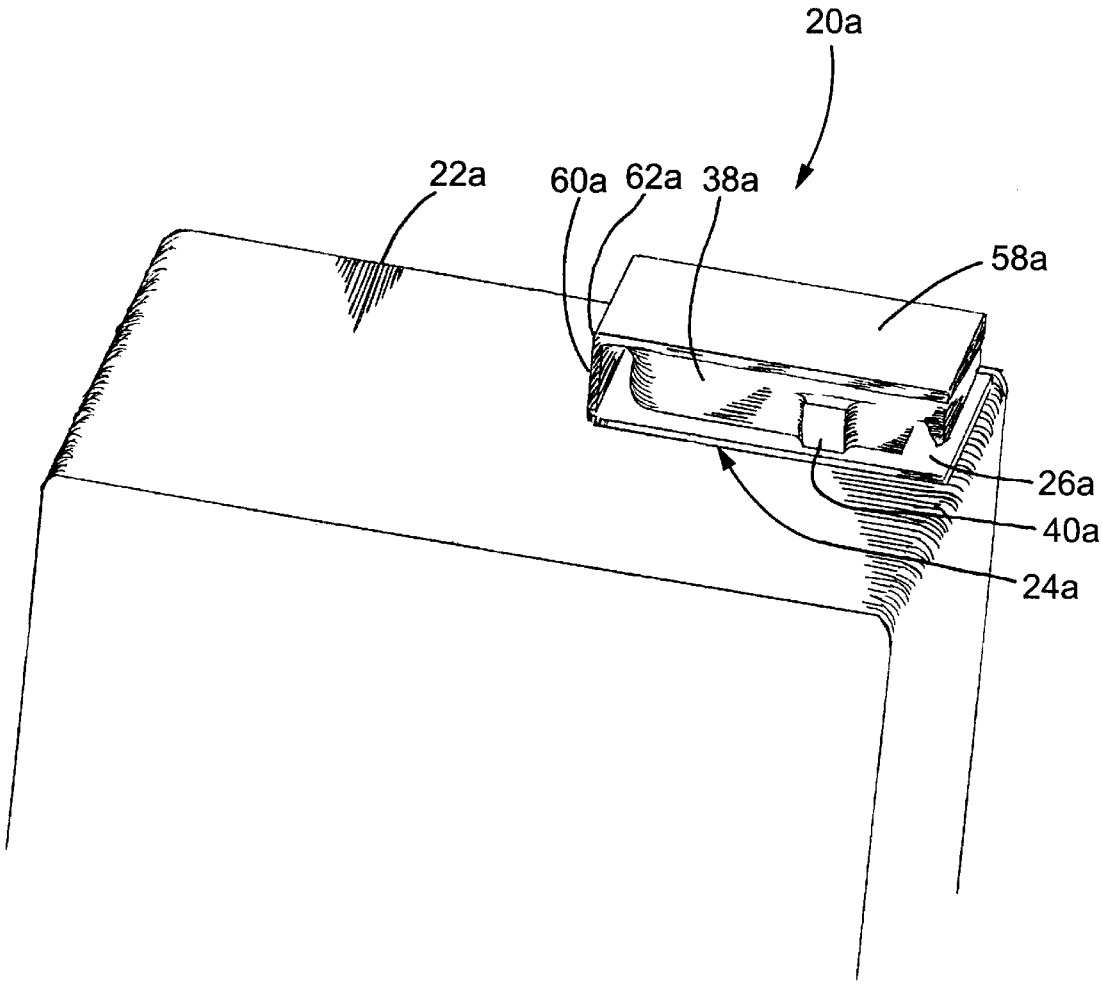
FIG. 10 is a perspective view of a second preferred embodiment of the present invention shown in a closed position.
Figure 11:
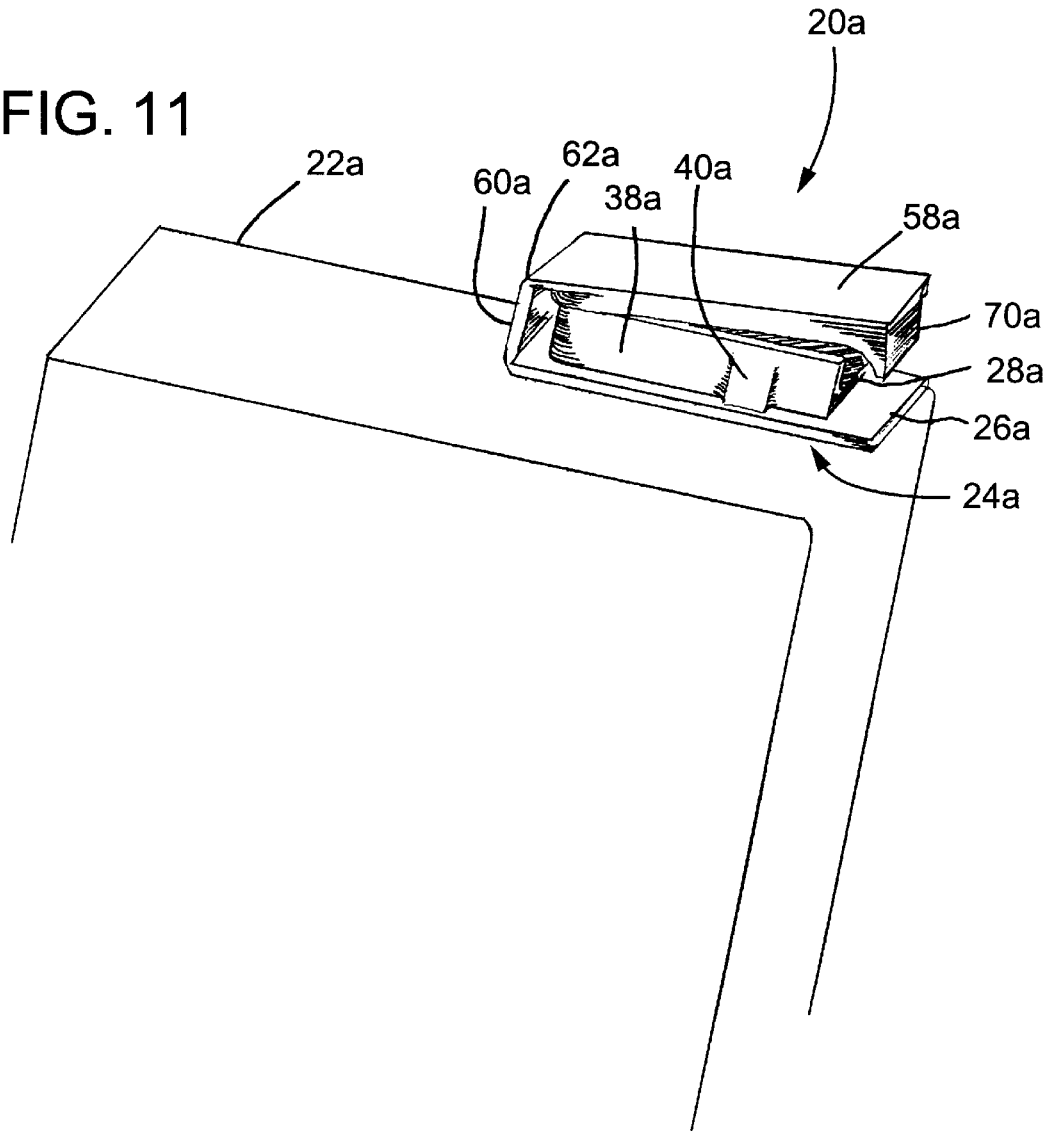
FIG. 11 is a perspective view of a second preferred embodiment shown with the cover partially opened and activating the lever arm to open the package.
Figure 12:
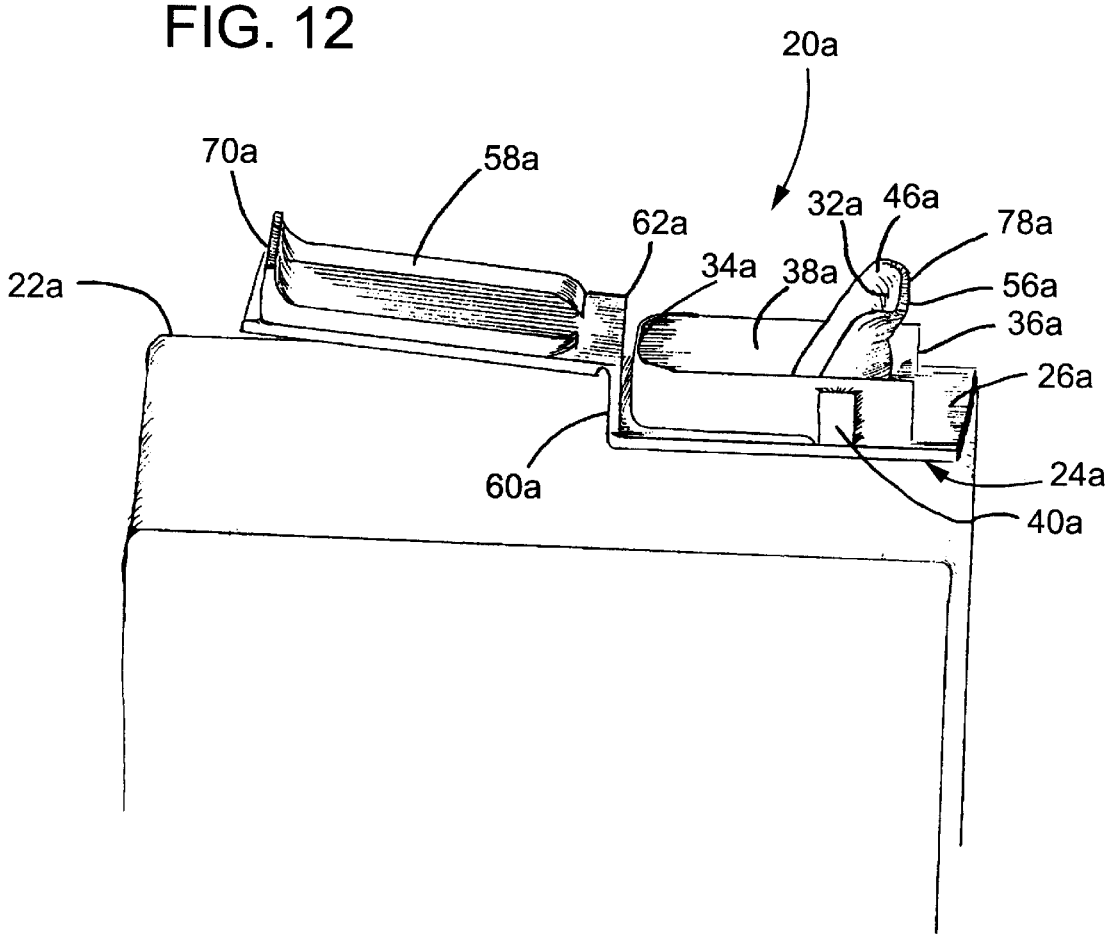
FIG. 12 is a perspective view of the second preferred embodiment in the fully open position.

As shown best in FIGS. 6 and 9, base 24 includes a canted surface 50 which cooperates with underside 48 of lever 28 to effectively seal lever 28 to base 24 in the open position shown in FIG. 8. In other words, liquid from container 22 cannot pass between lever 28 and base 24 at nexus or seal 52 due to the sealing connection between base 24 and lever 28. Rather, the liquid from the container 22 must pass entirely through opening 54 (see FIG. 8) provided in base 24 defined by raised wall 34.

In order to substantially prevent lever 28 from being closed by the liquid acting against underside 48 during pouring, the present invention could include a positive stopping mechanism on lever 28. For example, sockets and arms 42 could be hexagonally shaped to thereby allow lever 28 to move in discrete motions and only when sufficient power is applied. Other forms of stopping mechanisms including clips, detents, locking grooves and the like could also be employed to thereby improve the pourability of the present invention.

In addition, FIG. 9 dramatically depicts the improved pour spout location of the present invention. As opposed to prior art devices which provide a relatively low pour spout, if any pour spout is provided at all, the present invention elevates pour spout 32 substantially above base 24 and away from package 22. This allows the liquid to follow a more natural flow from package 22, and due to channel walls 46 on pour spout 32, the liquid can be more accurately directed out of the package 22. This is accomplished while at the same time providing a fitment 20 which can be reclosed into the position shown in FIGS. 1 and 6 wherein the fitment 20 occupies relatively little space and is substantially insusceptible to breakage during shipping and handling. Moreover, since the lifting force for opening package 22 using fitment 20 is entirely directed against underside 56 of pour spout 32, when an operator wishes to open package 22, the fingers of the operator are not inclined to enter package 22 and contaminate the fluid contained therein. In other words, there is no need for the operator to direct force downwardly into package 22 as with many prior art designs in that the majority of the force needed for opening will be directed away from package 22.

In second preferred embodiment of the present invention shown in FIGS. 10–20, fitment 20*a* is provided with a cover 58*a* which is adapted to pivot relative to base 24*a*. As will be described herein, cover 58*a* serves many functions which provide advantages including, but not limited to, preventing the intrusion of contaminates into package 22*a* and serving as tamper evidence to the user of the package. In addition, through the unique features of the preferred embodiment, cover 58*a* can automatically open package 22*a* by lifting upward on pour spout 32*a* as cover 58*a* is hinged about base 24*a*. This action virtually eliminates finger intrusion into package 22*a*.

Figure 13:
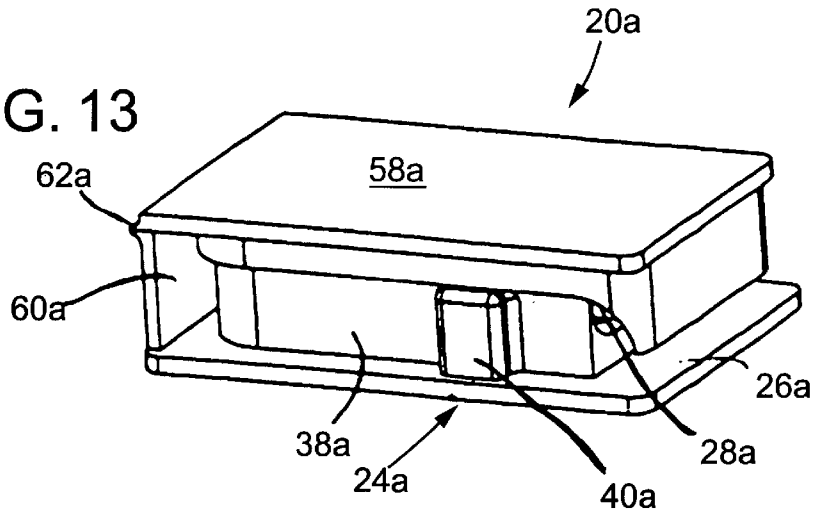
FIG. 13 is a perspective view of the second preferred embodiment of the fitment in the closed position.
Figure 14:
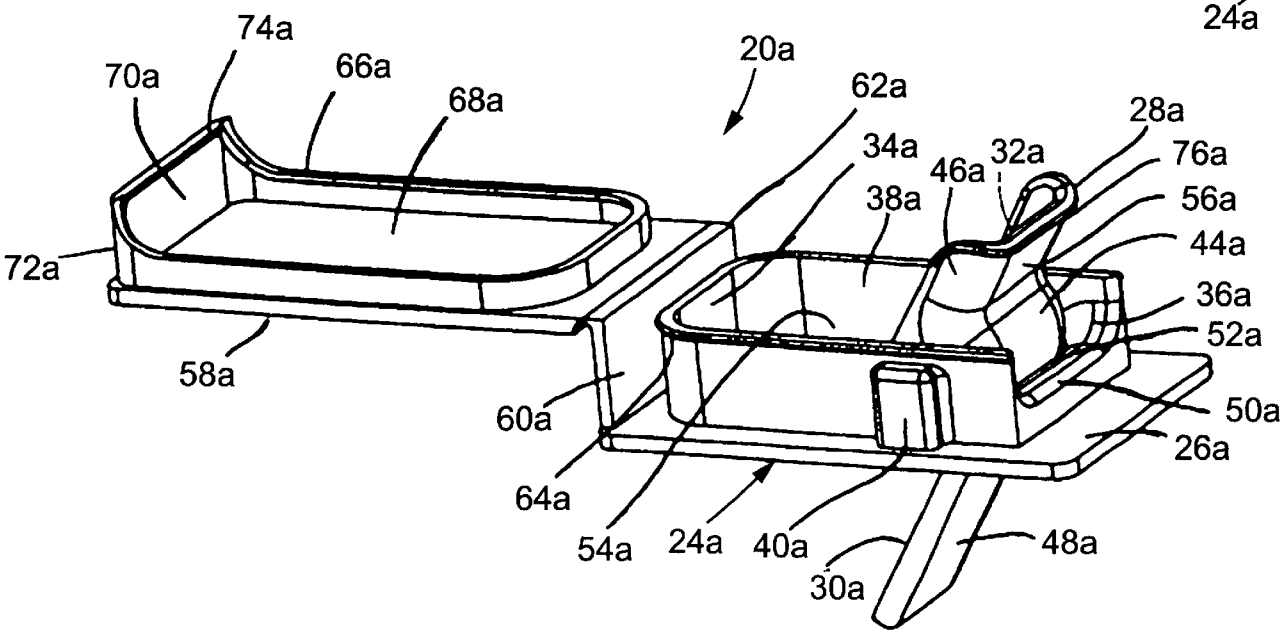
FIG. 14 is a perspective view of the second preferred embodiment of the fitment in the open position.
Figure 15:
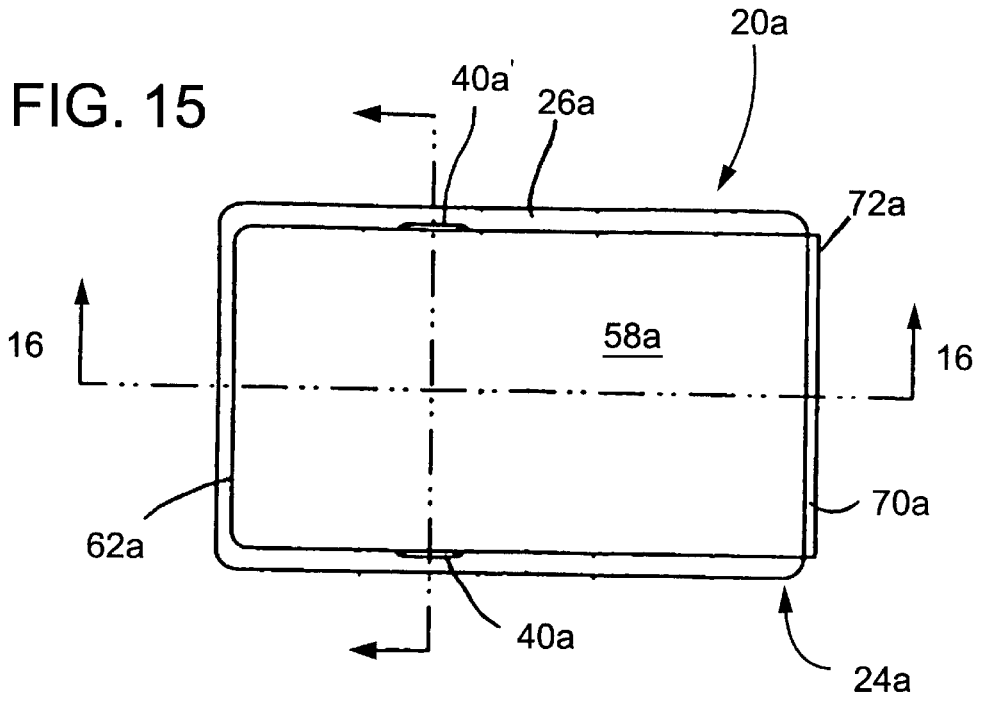
FIG. 15 is a top view of the second preferred embodiment in the closed position.

Referring now to FIG. 13, the second preferred embodiment is shown in perspective as being quite similar to the embodiments shown in FIGS. 1–9.However, base 24*a* includes rear wall 60*a* which defines pivot 62*a* between cover 58*a* and base 24*a*. Other than rear wall 60*a* and pivot 62*a*, base 24*a* and lever 28*a* are substantially the same as the first embodiment. However, raised wall 34*a* of base 24*a* does include outwardly extending lip 64*a* (see FIG. 14) which interacts with sealing rim 66*a* provided on underside 68*a* of cover 58*a*. Sealing rim 66*a* is dimensioned to be slightly larger than lip 64*a* such that in the closed position of FIG. 13, cover 58*a* substantially seals against raised wall 34*a* and prevents the contents of package 24*a* from being dispensed.

Cover 58*a* also includes an oversized, downwardly depending, actuator 70*a* proximate front 72*a* of cover 58*a*. It is actuator 70*a* which cooperates with pour spout 32*a* to automatically open fitment 20*a* upon fitment 20*a* moving between the positions shown respectively in FIGS. 10, 11, and 12.

Figure 16:
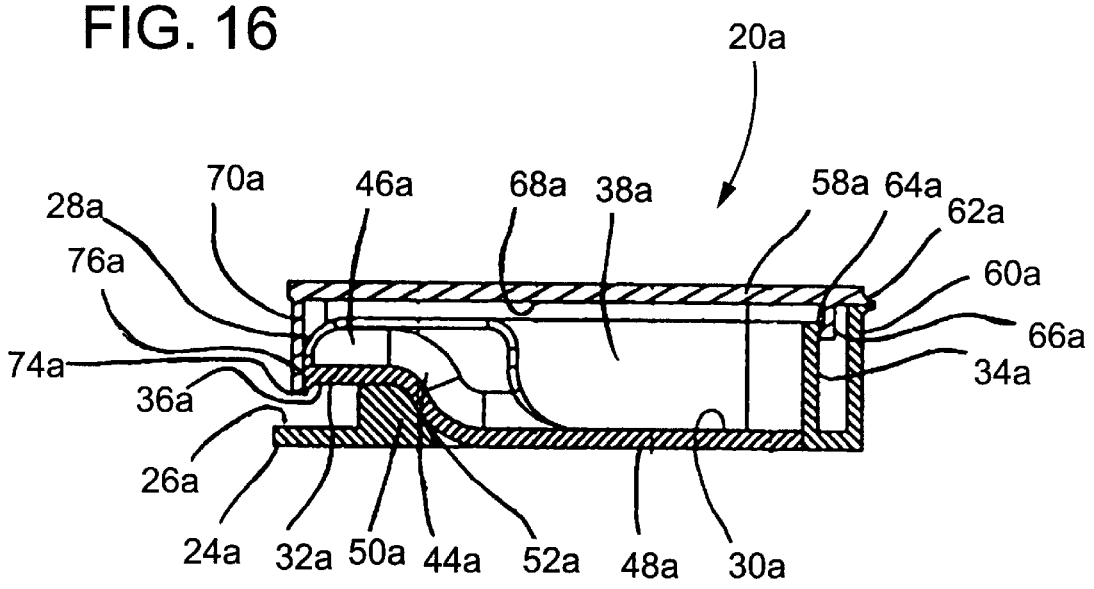
FIG. 16 is a sectional view of FIG. 15 taken along line 16—16.
Figure 17:
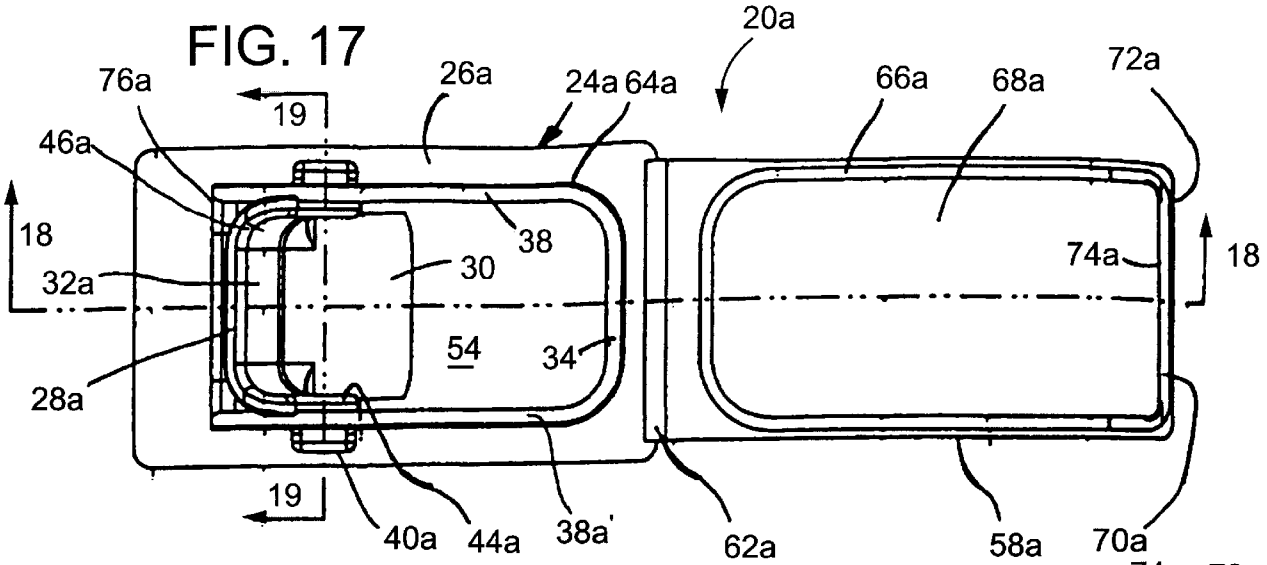
FIG. 17 is a top view of the second preferred embodiment of the fitment shown in open position.
Figure 18:
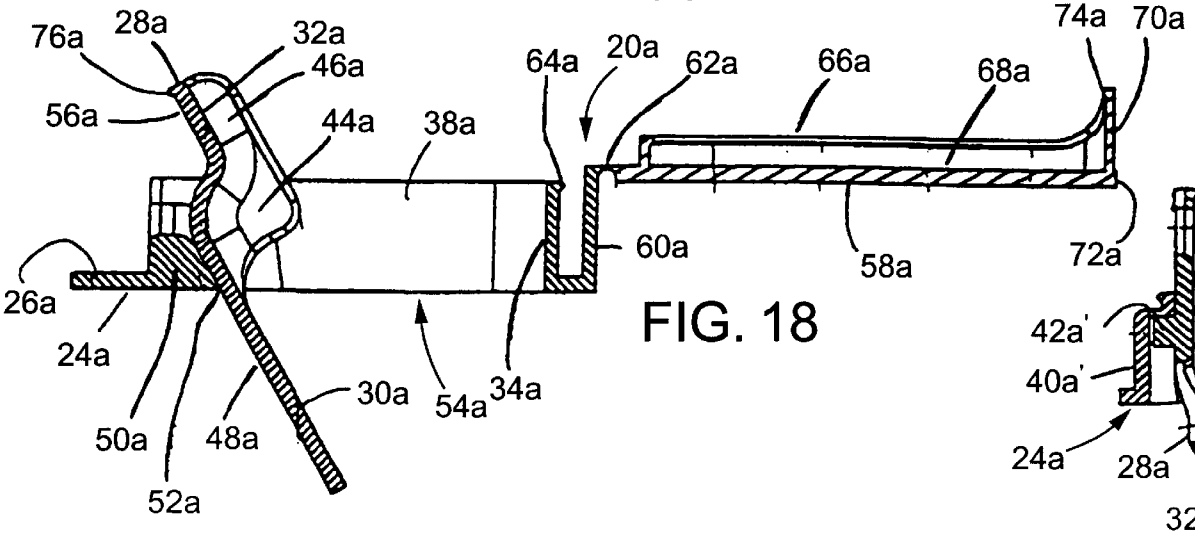
FIG. 18 is a sectional view of FIG. 17 taken along line 18—18.
Figure 19:
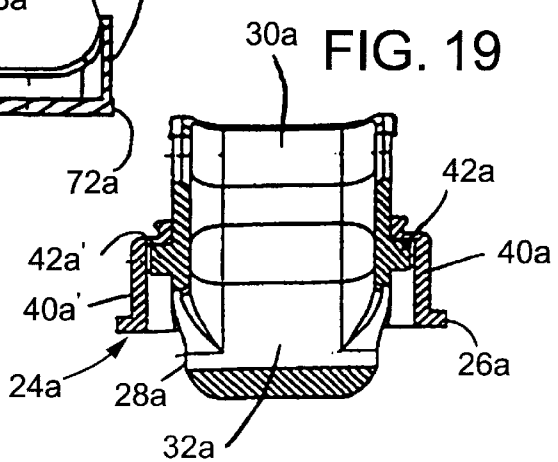
FIG. 19 is a section view of FIG. 17 taken along line 19—19.
Figure 20:
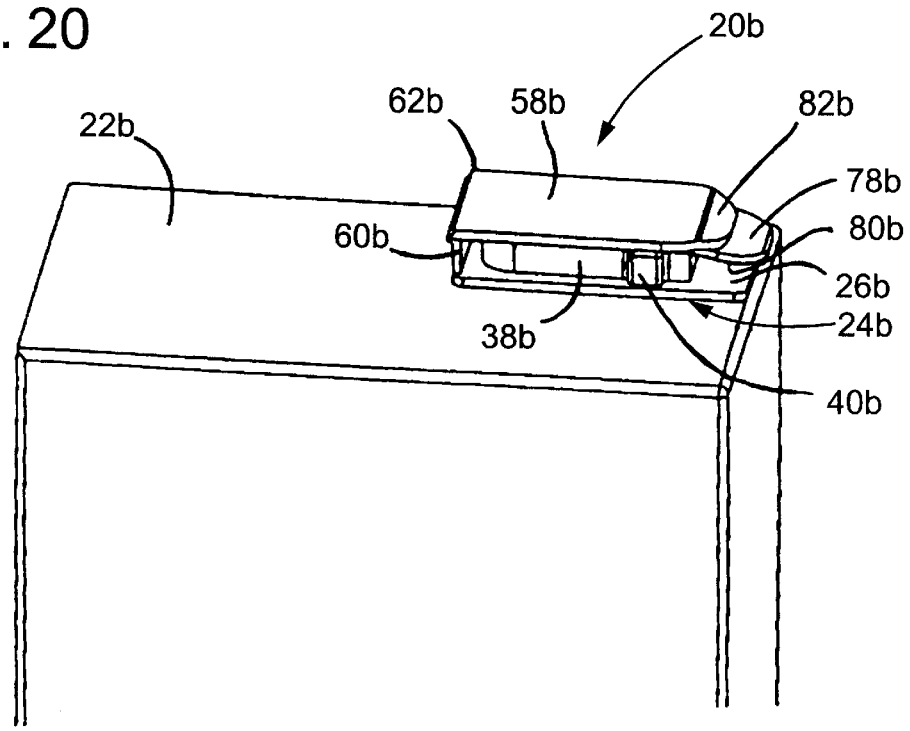
FIG. 20 is a perspective view of a third preferred embodiment of the present invention shown in the closed position.
Figure 21:
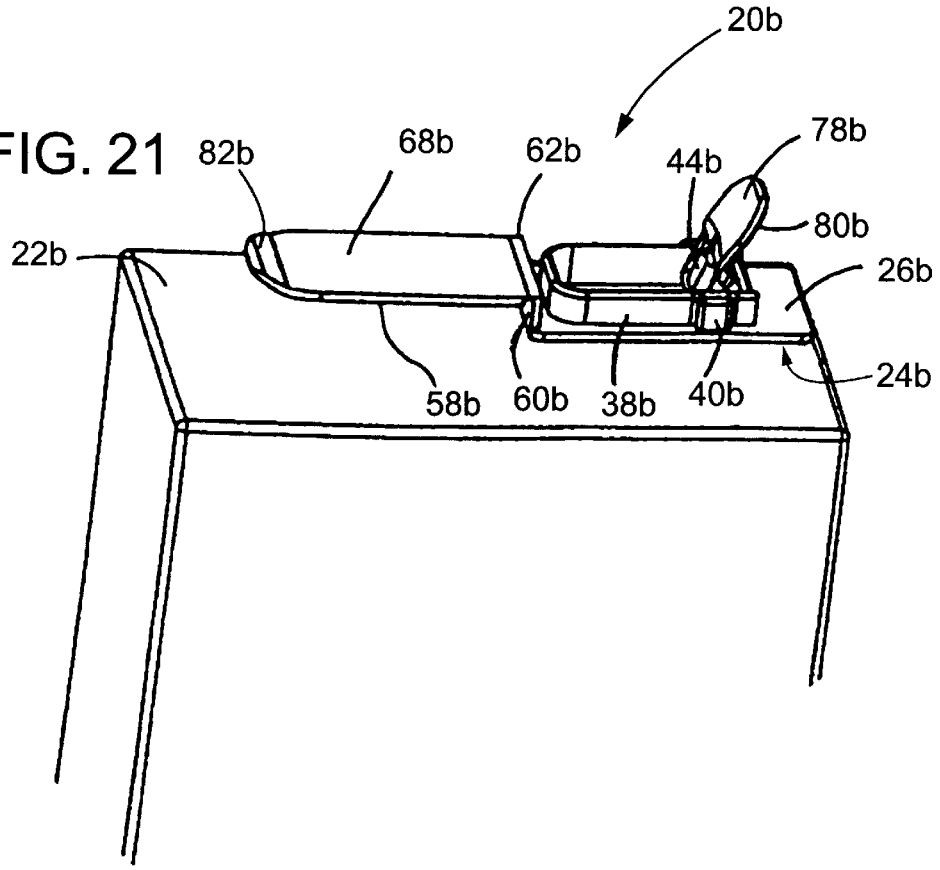
FIG. 21 is a perspective view of the third preferred embodiment shown in the open position.

While there are a number mechanisms for accomplishing this interaction between actuator 70*a* and the pour spout of lever 28*a*, in the second preferred embodiment, as best shown in FIG. 16, actuator 70*a* includes inwardly extending ridge 74*a* which snaps over pour spout 32*a* in the closed position, and resides below downwardly extending detent 76*a* of pour spout 32*a*. Therefore upon cover 58*a* being moved from the fully closed position shown in FIG. 10, to the partially opened position shown in FIG. 11, actuator 70*a* and corresponding ridge 74*a* pull against detent 76*a* and pour spout 32*a* to lift pour spout 32*a* upwardly and force rear portion 30*a* into the container 22*a*, through the scored area, as lever 28*a* pivots about transition zone 44*a*. Upon reaching the fully open position shown in FIG. 12, further motion of cover 58*a* causes it to separate from pour spout 32*a* by having ridge 74*a* elastically deform away from detent 76*a*. Cover 58*a* can therefore attain the fully opened position shown in FIG. 12 wherein the contents of package 22*a* can freely exit the container through fitment 20*a* opening 54*a* shown in FIG. 17.

In another embodiment of the present invention, actuator 70*a* could be physically attached to pour spout 32*a* when initially purchased, and be provided with a frangible portion which is sufficiently strong to allow lever 28*a* to press through paperboard package 22*a*, but upon further force being exerted will break and thereby allow cover 58*a* to fully detach from pour spout 32*a*. Such a frangible portion could thereby serve as tamper evidence in that the user could easily identify an already opened container if the frangible portion were to be broken.

Figure 22:
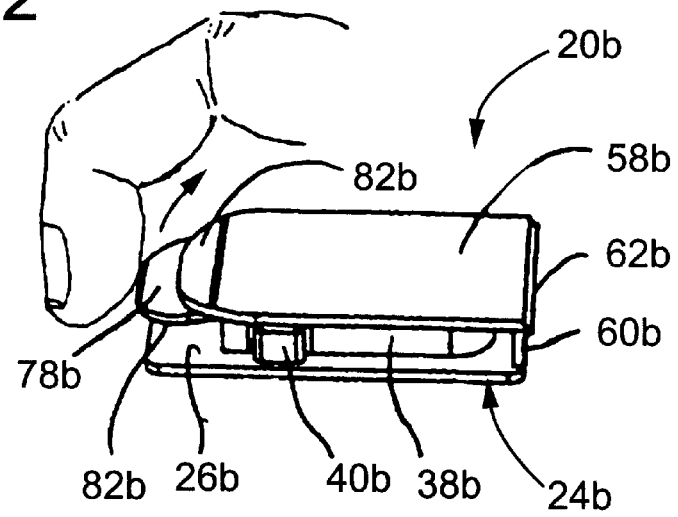
FIG. 22 is a perspective view of the third preferred embodiment of the fitment in the fully closed position.
Figure 23:
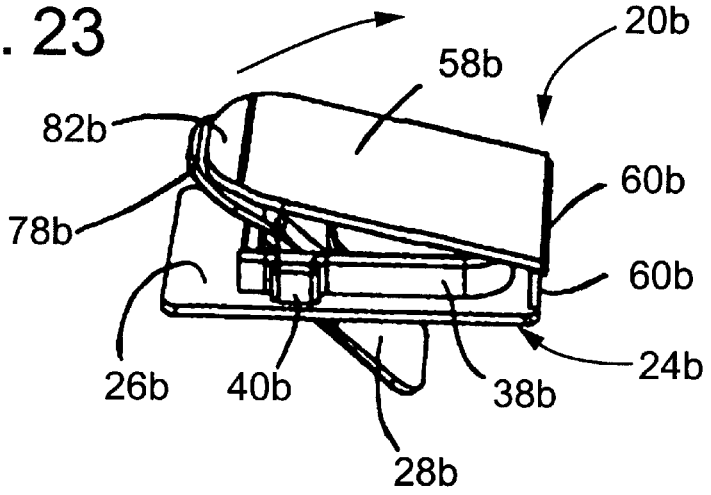
FIG. 23 is a perspective view of the third preferred embodiment of the fitment in a partially open position.
Figure 24:
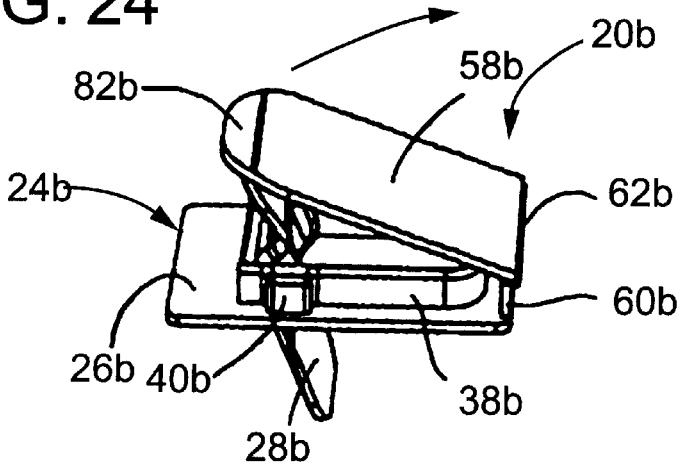
FIG. 24 is a perspective view of the third preferred embodiment of the fitment in a further open position with the lever locked in place.
Figure 25:
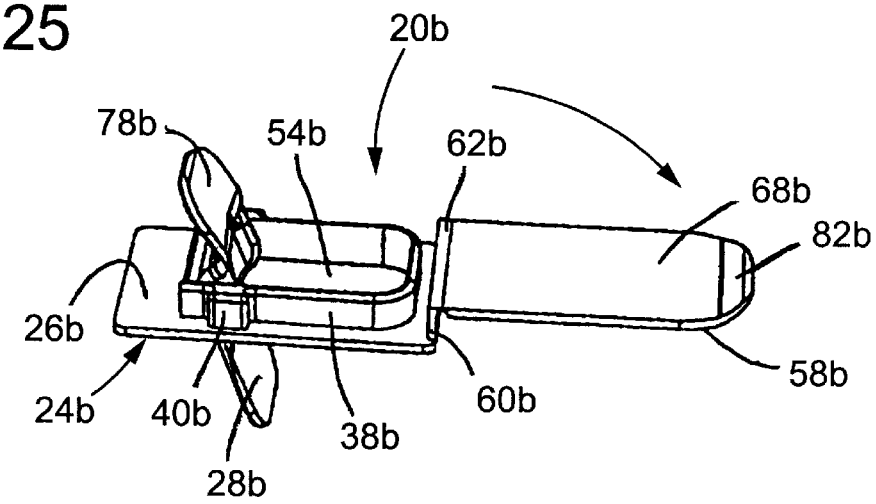
FIG. 25 is a perspective view of the third preferred embodiment of the fitment in the fully open position.
Figure 26:
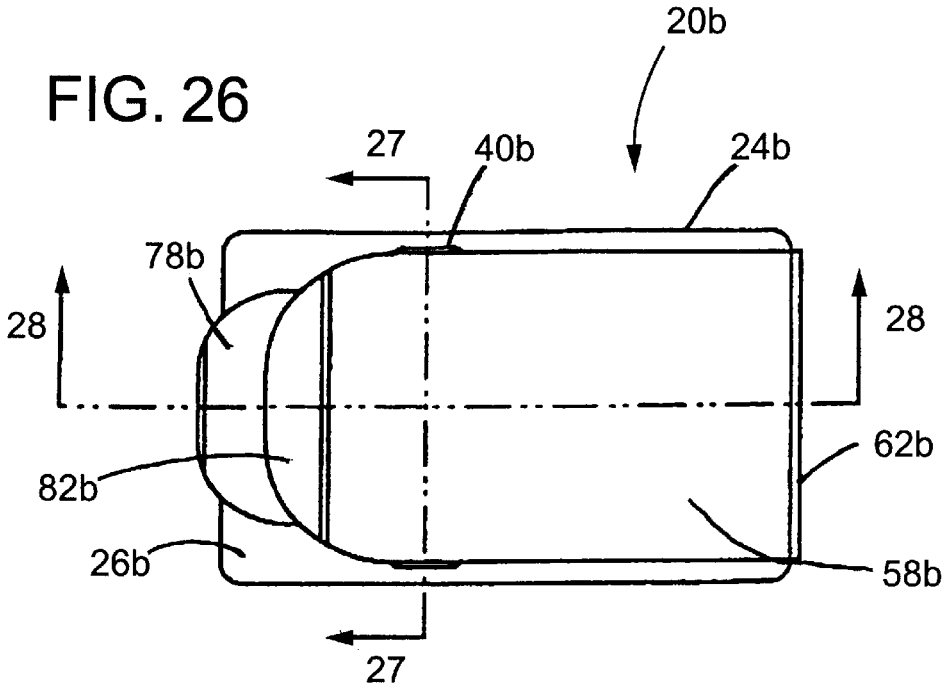
FIG. 26 is a top view of the third preferred embodiment of the fitment.
Figure 27:
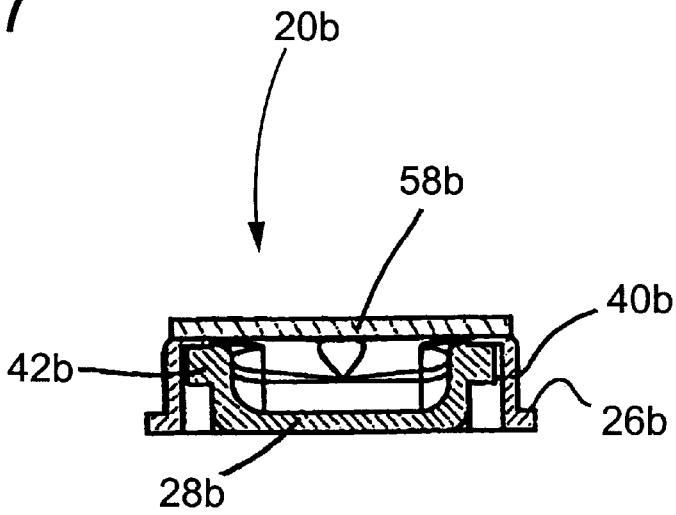
FIG. 27 is a sectional view of FIG. 26 taken along line 27—27.
Figure 28:
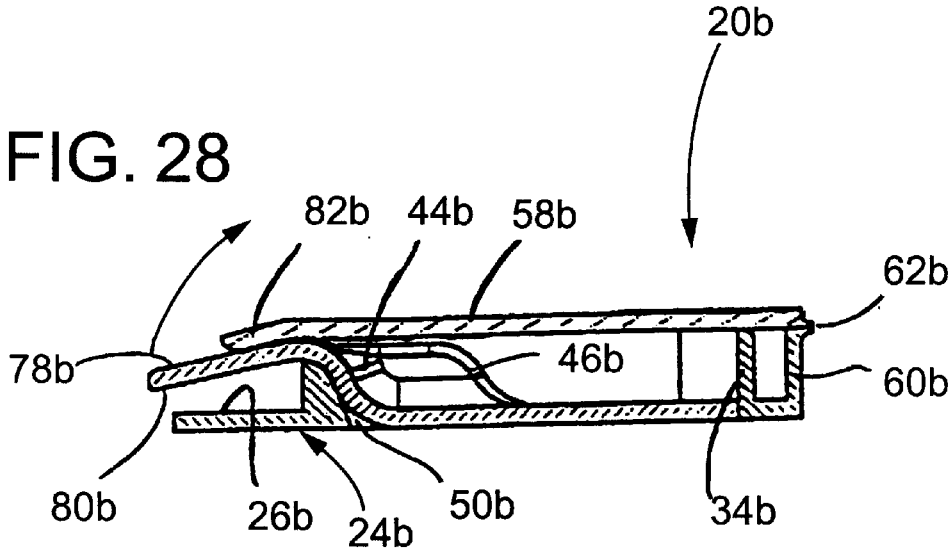
FIG. 28 is a sectional view of FIG. 26 taken along line 28—28.
Figure 29:
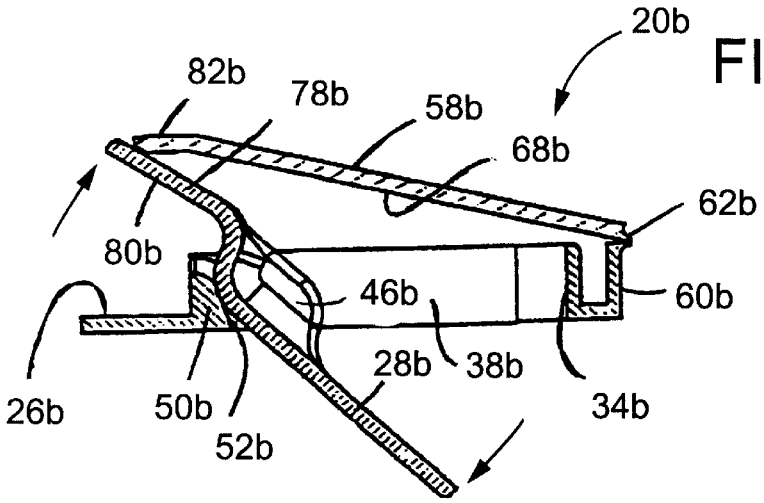
FIG. 29 is a sectional view of the third preferred embodiment of the fitment in a partially open position.
Figure 30:
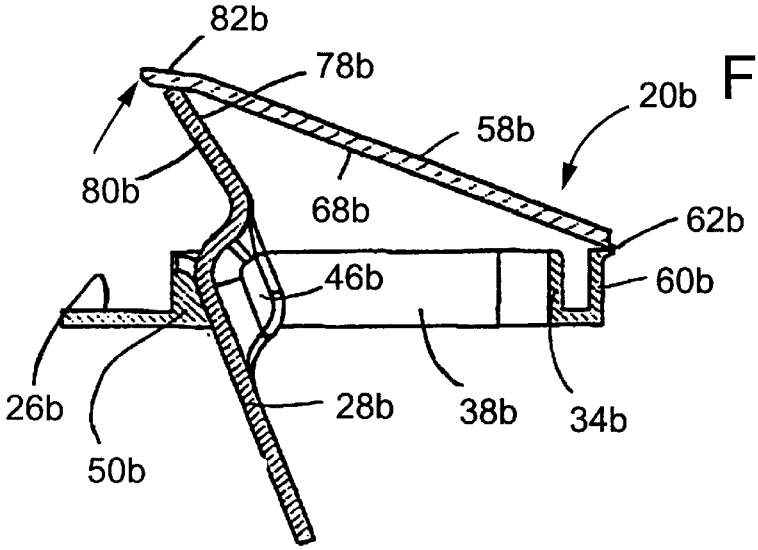
FIG. 30 is a sectional view of the third preferred embodiment of the fitment in a partially open position with the lever locked in place.
Figure 31:
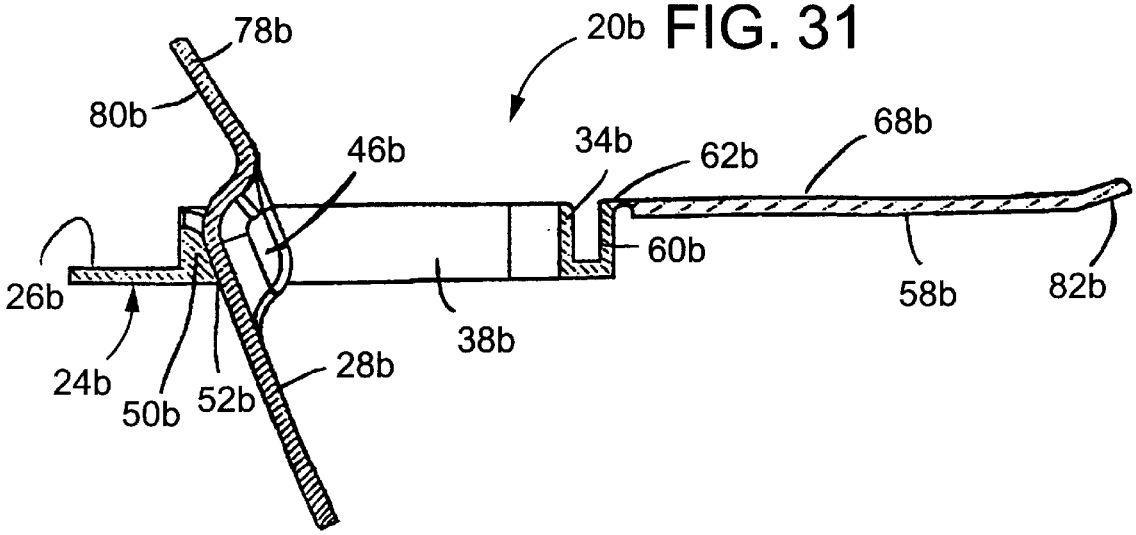
FIG. 31 is a sectional view of the third preferred embodiment of the fitment in the fully open position.

A third preferred embodiment of the present invention is shown in FIGS. 20–32. As shown therein, fitment 20*b* is adapted to be attached to paperboard package 22*b* and includes a base 24*b*, a lever 28*b* (see FIG. 24), and a cover 58*b*. However, lever 28*b* includes extended tongue 78*b* which extends past front 82*b* of cover 58*b*. Therefore when a user attempts to open the fitment, as best shown in FIG. 22, the lifting force is applied against underside 80*b* of tongue 78*b*, and not against cover 58*b*. As fitment 20*b* continues to be opened the pulling force is continued to be directed against underside 80*b* as best shown in FIG. 23, until such time that the lever 28*b* reaches a locked position shown in FIG. 24. As shown in FIGS. 24 and 30, lever 28*b* reaches a locked position wherein underside 48*b* of lever 28*b* engages canted surface 50*b* of base 24*b* and cannot pivot further. The respective pivot points of lever 28*b* and cover 58*b*, as well as the lengths of cover 58*b* and tongue 78*b*, are dimensioned such that at the point where lever 28*b* engages canted surface 50*b*, extended lip 82*b* of cover 58*b* becomes exposed and the operator can then direct lifting force against lip 82*b* to place fitment 20*b* in the fully open position shown in FIGS. 25 and 31. In other words, at about 60 degrees of rotation, lever 28*b* becomes locked, and lip 82*b* overcomes tongue 78*b*. Further rotation by the user is then directed only against lip 82*b*. One benefit to this embodiment over that shown in the second preferred embodiment is that the consumer need not rely on the snap between the cover and the lever to achieve tearing into the package, but rather the force for opening the package can be fully derived from the lifting force of the user imparted directly against the underside of the lever.

Figure 32:
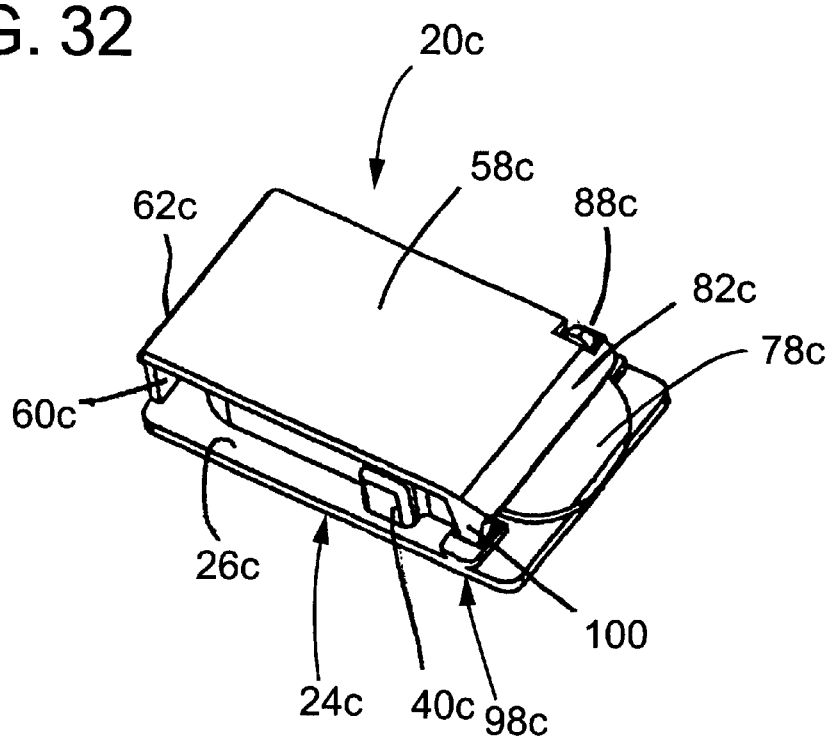
FIG. 32 is a perspective view of a fourth preferred embodiment of the fitment in a closed position.
Figure 33:
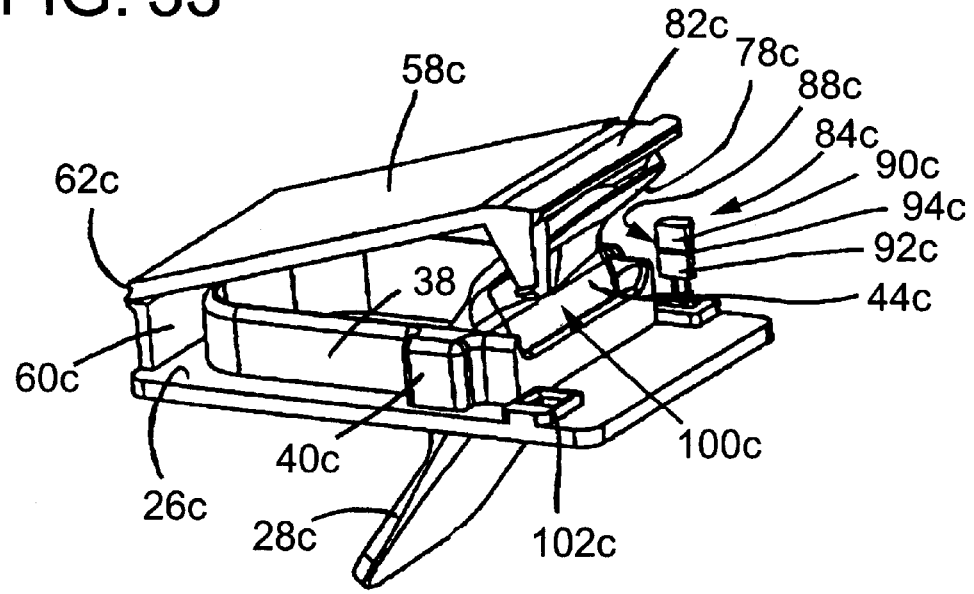
FIG. 33 is a perspective view of the fourth preferred embodiment of the fitment partially open and specifically showing the tamper indicator broken and the hold down snap released.
Figure 34:
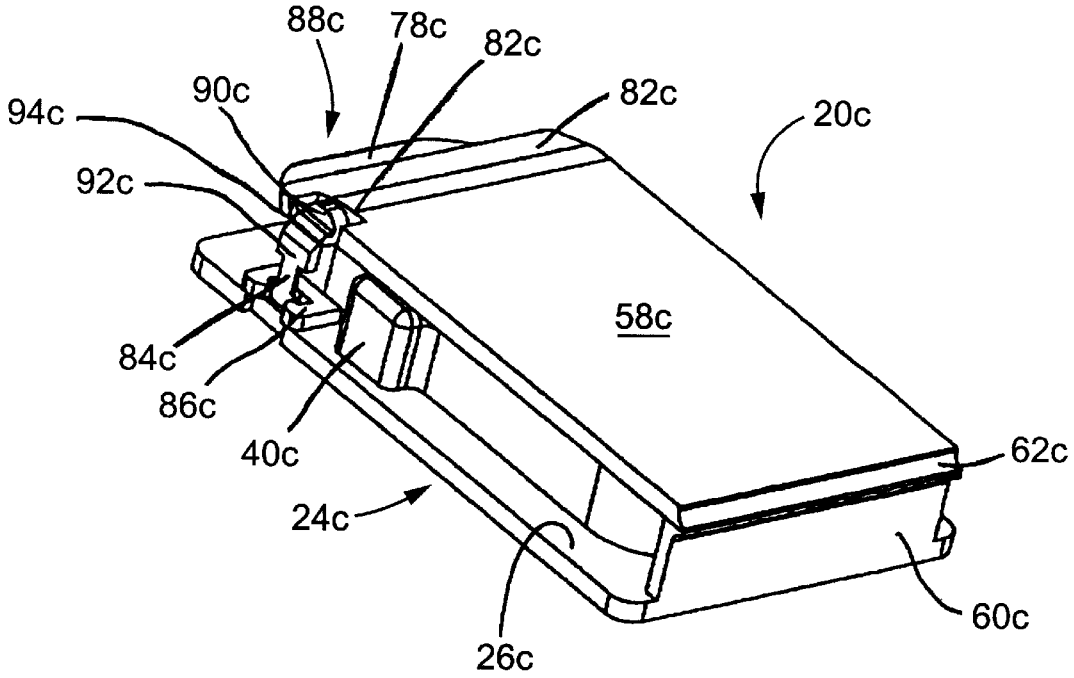
FIG. 34 is a perspective view of the fourth preferred embodiment of the fitment with the fitment closed and the tamper indicator intact.
Figure 35:
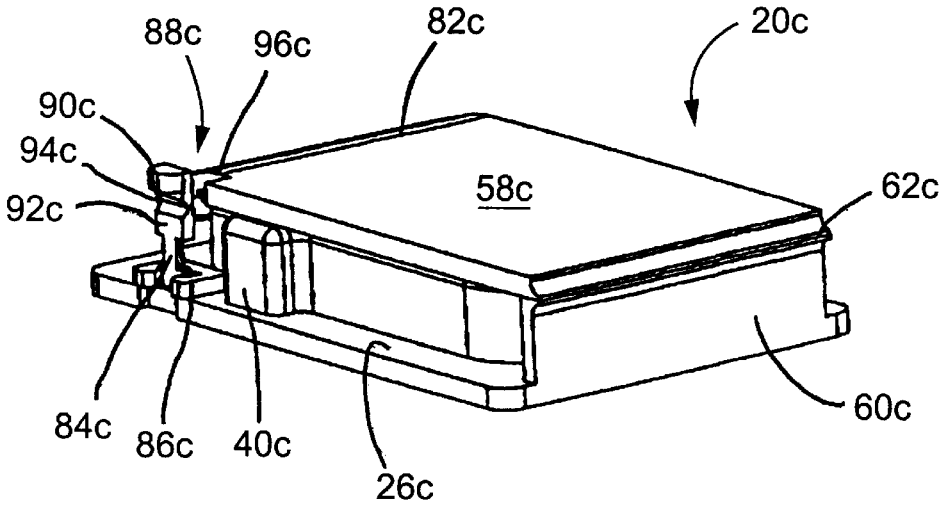
FIG. 35 is a perspective view of the fourth preferred embodiment of the fitment showing the fitment in a partially open position, the tamper indicator broken, and the hold down snap released.

A fourth preferred embodiment is shown in FIGS. 32–35 which is identical to the third embodiment except that it additionally includes tamper evidence indicators. As shown in FIGS. 34 and 35, base 24*c* includes a tamper indicator 84*c* connected to base 24*c* at platform 86*c*. Tamper indicator 84*c* includes a deformable head 88*c* having upper portion 90*c* and lower portion 92*c* connected at hinge 94*c*. In the fully closed position shown in FIG. 34, upper portion 90*c* is connected to cover 58*c* along a frangible portion 96*c*. When cover 58*c* is move slightly away from base 24*c*, the frangible portion 96*c* is broken which allows the upper portion 90*c* of the deformable head 88*c* to plastically deform into an upright position shown in FIG. 35. This provides the user with an indication that the fitment 20*c* has already been opened or in other words tampered with.

This embodiment also includes a hold down snap. As shown in FIGS. 32 and 33, hold down snap 98*c* includes lower clip 100*c* which is adapted to elastically deform as it moves through locking aperture 102*c* of base 24. In other words, when cover 58*c* is in the fully closed position shown in FIG. 32, lower clip 100*c* is provided through locking aperture 102*c* and is biased outwardly to engage clip 100*c* against the underside of base 24*c*. However when cover 58*c* is moved away from base 24*c*, locking clip 100*c* is able to elastically deform inward to allow passage of clip 100*c* through aperture 102*c*. Hold down snap 98*c* accomplishes, among other things, the function of ensuring that both sides of fitment 20*c* remain closed and that the fitment 20*c* cannot be tampered with by prying the side of cover 58*c* opposite tamper indicator 84*c* away from base 24*c* and thereby tampering with the contents of package 22*c*. Since tamper indicator 84*c* is provided on a side of fitment 20*c*, hold down snap 98*c* is provided on the opposite side to ensure that the assembly stays closed and none of the components of the fitment 20*c* or the contents of container 22*c* can be altered.

A fifth preferred embodiment is shown in FIGS. 36–39. The fifth preferred embodiment incorporates the hold-down snap 98*d* of the fourth preferred embodiment, but employs different mechanisms for lifting the lever 28*d* forward portion 32*d* away from base 24*d*. More specifically, it can be seen in FIG. 38 that cover 58*d* includes downwardly depending arms 104*d* having inwardly directed ridges 106*d*. In so doing, ridges 106*d* and arms 104*d* cooperate to define pin slots 108*d*. In the closed position, pin slots 108*d* are adapted to receive pins 110*d* which laterally extend from forward portion 32*d* of lever 28*d*. Therefore, when an operator attempts to open fitment 20*d* by pulling upwardly on lip 82*d* of cover 58*d*, ridges 106*d* pull against pins 110*d* and in turn, pull forward portion 32*d* of lever 28*d* upwardly. This causes lever 28*d* to pivot about transition zone 44*d*, specifically arms 42*d* within sockets 40*d*, and causes rear portion 30*d* of lever 28*d* to penetrate through the scored area of paperboard package 22*d* to create an opening. This transition is shown respectively in FIGS. 36 and 37.

Figure 38:
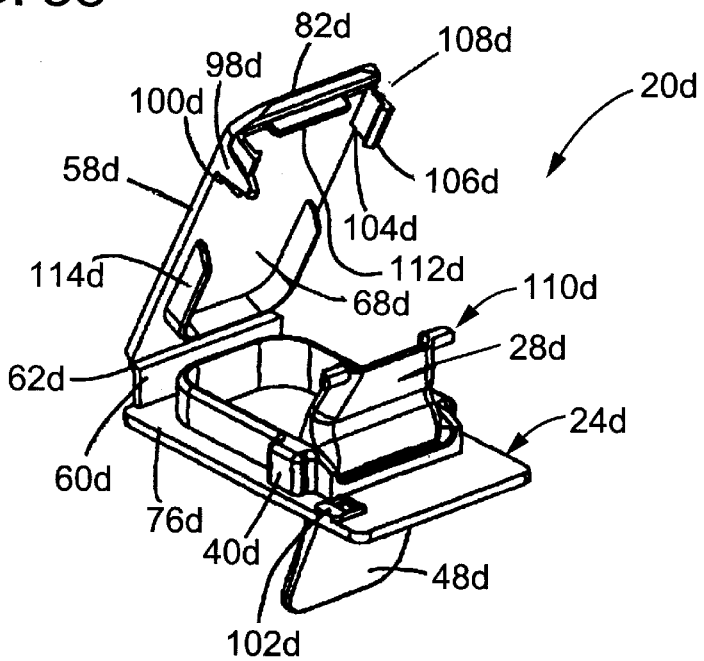
FIG. 38 is a perspective view of the fifth preferred embodiment of the fitment in a partially open position with the lever locked in place.
Figure 39:
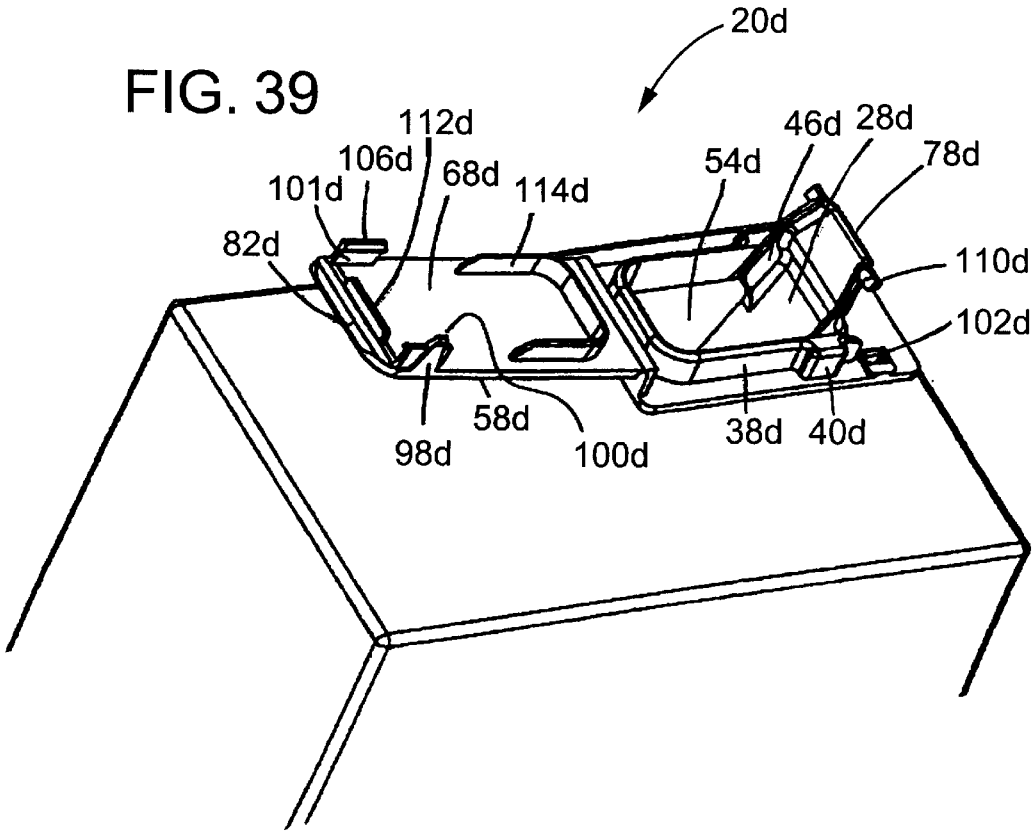
FIG. 39 is a perspective view of the fifth preferred embodiment of the fitment shown in a fully open position.

In FIG. 38, it is shown that after a certain degree of arcuate travel, approximately sixty degrees in the preferred embodiment, lever 28*d* reaches a locked position wherein underside 48*d* of lever 28*d* engages canted surface 50*d* of base 24*d*. The lever 28*d* can therefore pivot no further than this position and continued force applied to cover 58*d* by the operator will cause cover 58*d* to separate from tongue 78*d* of lever 28*d*. More specifically, it can be seen that cover 58*d* includes tamper-evident flap 112*d* which in the closed position is attached to tongue 78*d* of lever 28*d* along a frangible portion. However, upon lever 28*d* reaching the locked position, continued force against cover 58*d* will cause the frangible portion to break and thereby allow the cover 58*d* to continue rotation about pivot 62*d* to pass from the position shown in FIG. 38 to the fully open position shown in FIG. 39. FIG. 39 also shows that cover 58*d* includes a partial sealing rim 114*d* which frictionally interfits with raised wall 34*d* of base 24*d*.

Figure 36:
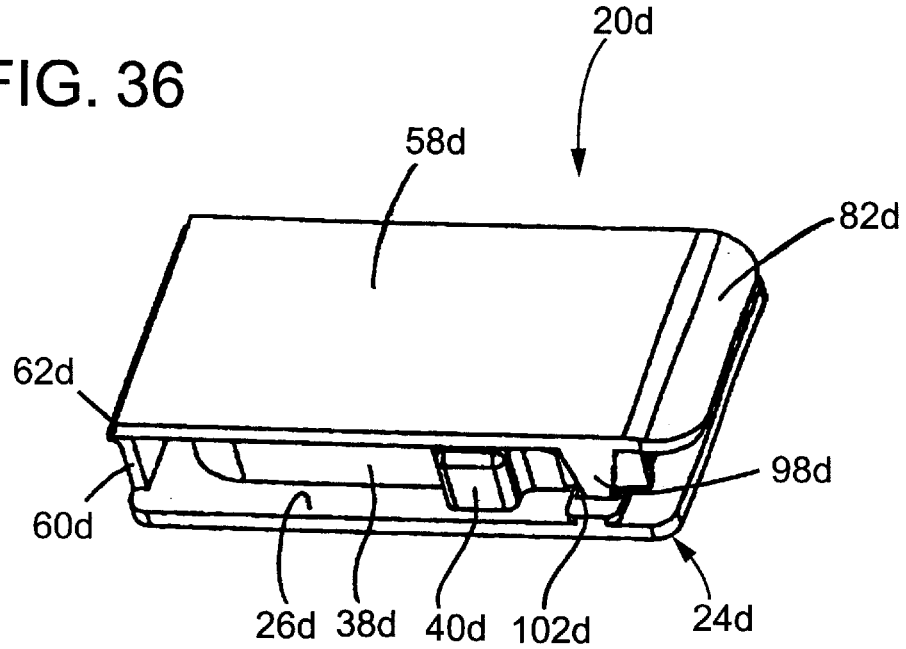
FIG. 36 is a perspective view of the fifth preferred embodiment of the fitment shown in a closed position.
Figure 37:
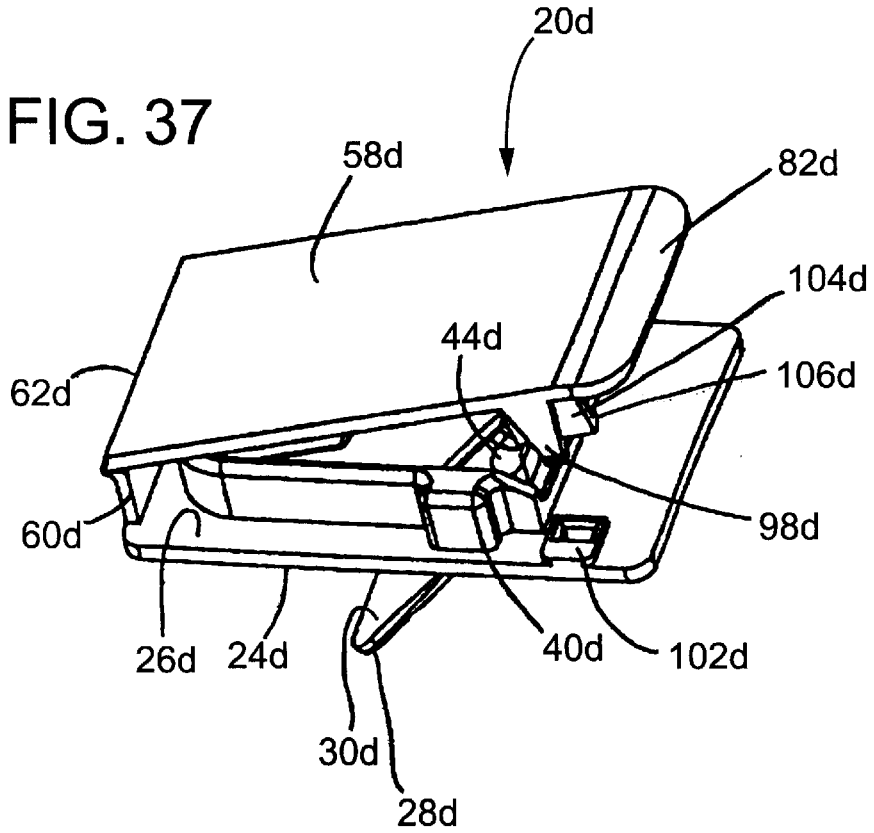
FIG. 37 is a perspective view of the fifth preferred embodiment of the fitment in a partially open position with the cover lifting the lever away from the base.

FIGS. 36 and 37 best show the features of hold down snap 98*d* and the cooperating locking aperture 102*d* provided on base 24*d*. Snap 98*d*, and its lower clip 100*d* act identically as they do in the fourth preferred embodiment, and therefore can act to hold cover 58*d* in a closed position after opening and after the frangible portion is broken. Therefore after the user is finished using package 22*d*, cover 58*d* can be pivoted against base 24*d* for resealing purposes, and hold down snap 98*d* will interact with locking aperture 102*d* to hold cover 58*d* in the closed position.

From the foregoing it can therefore be seen to one of ordinary skill in the art that the present invention provides a two piece fitment for a paperboard package with improved pourability, enhanced anti-finger intrusion protection, positive tamper evidence, and a mechanism for automatically opening the package upon movement of an outer cover. The improved pourability is accomplished by, among other things, providing a pour spout which can be moved into an operative position wherein it is substantially raised above the surface of the base, and includes channel walls on the pour spout to more accurately direct the contents out of the package. The present invention provides a mechanism wherein the force required for opening the package can be directed entirely against the underside of the pour spout and thereby away from the package, to thereby substantially eliminate the possibility of finger intrusion into the container. This finger intrusion protection is even more evident in an alternative embodiment wherein a cover is also pivotally attached to the base and temporarily attached to the pour spout of the lever. Therefore, when the cover is pivoted away from the base, it automatically pulls the pour spout with it, and causes the rearward portion of the lever to pass through, and thereby open, the package. The cover then breaks away from the pour spout leaving the lever in the fully operable position, and the cover fully hinged away from the base.

What is claimed is:

1. A reclosable package fitment for a container having a pouring edge comprising:

a base adapted to be attached to the container, the base including an opening therethrough;

a lever having a rearward puncturing end and a forward pour spout end to be juxtaposed the pouring edge of the container, the lever being recessed within the opening and pivotally attached to the base intermediate the pour spout end such that a lifting force directed against an underside of the lever at the pour spout end causes the lever pour spout to be raised above the base to an open position and the lever to pivot relative to the base which causes the lever puncturing end to engage and puncture the container to thereby open the container; and the lever pour spout end having an open channel shaped cross-section.

2. The reclosable package fitment of claim 1 wherein the base includes a canted surface portion transverse to the opening, the canted surface acting as a physical stop and a seal between an underside of the lever pour spout end and canted surface such that pivotal movement of the lever to the open position is limited to an acute angle to a plane coincident with an interface of the base and the container.

3. The reclosable package fitment of claim 2 wherein the acute angle is approximately 60 degrees to thereby allow the lever pour spout end to extend upward and away from the base such that when a container provided with the fitment is opened and tilted to pour contents from the container, the contents pass through the opening in the base along the pour spout channel in a continuous stream away from the container.

4. The reclosable package fitment of claim 1 wherein the pivotable attachment between the base and lever comprises pivot arms fitted within sockets to pivotally attach the lever to the base.

5. A reclosable package fitment comprising:

a base adapted to be attached to a container, the base including an opening therethrough;

a lever recessed within the opening and pivotally attached to the base intermediate a lever pour spout end and a lever puncturing end;

a cover attached to the base, the cover being hinged to the base independently of the lever such that a lifting force directed against an underside of the lever at the pour spout end causes the lever pour spout to be raised above the base to an open position and the lever to pivot relative to the base which causes the lever puncturing end to engage and puncture the container to thereby open the container and cause the cover to hinge away from the base and thereby prevent possible finger intrusion into the container during he opening of the fitment cover.

6. The reclosable package fitment of claim 5 wherein the cover is hinged to the base at a rear of the base proximate the puncturing end of the lever.

7. The reclosable package fitment of claim 5 wherein the lever pour spout end has a channel shaped cross-section.

8. The reclosable package fitment of claim 7 wherein the base includes a canted surface portion transverse to the opening, the canted surface acting as a physical stop and a seal between an underside of the lever pour spout end and canted surface such that pivotal movement of the lever to the open position is limited to an acute angle to a plane coincident with an interface of the base and the container.

9. The reclosable package fitment of claim 8 where the acute angle is approximately 60 degrees to thereby allow the lever pour spout end to extend upward and away from the base such that when a container provided with the fitment is tilted to pour contents from the container, the contents pass through the opening in the base along the pour spout channel in a continuous stream away from the container.

10. The reclosable package fitment of claim 9 wherein the base includes a tamper evident element that cooperates with a frangible portion of the cover so that frangible portion of the cover is broken when the cover is opened.

11. The reclosable package fitment of claim 5 wherein the lever extends past a front edge of the cover when the fitment is closed to facilitate access to the lever and thus the opening of the container.

12. The reclosable fitment of claim 5 wherein the base includes a recessed area proximate the pour spout end of the lever and the cover.

13. The reclosable package fitment of claim 5 wherein the pivotable attachment between the base and lever comprises pivot arms fitted within sockets to pivotally attach the lever to the base.

14. A reclosable package fitment comprising:

a base adapted to be attached to a container, the base including an opening therethrough;

a lever recessed within the opening and pivotally attached to the base to pivot between a closed position and an open position, the lever is pivotally attached to the base intermediate a lever pour spout end and a lever puncturing end;

a cover attached to the base, the cover being hinged to the base independently of the lever;

the cover and lever pour spout end cooperating to move in unison upwardly from the base to thereby cause the lever pour spout to be raised above the base to an open position and the lever to pivot relative to the base which causes the lever puncturing end to engage and puncture the container to thereby open the container and cause the cover to hinge away from the base.

15. The reclosable package fitment of claim 14 wherein the lever pour spout end has a channel shaped cross-section.

16. The reclosable package fitment of claim 15 wherein the cover includes a lip that mechanically cooperates with the lever pour spout end to cause the pour spout end to move and pivot when a lifting force is applied to the cover in a region adjacent to the lip.

17. The reclosable package fitment of claim 16 wherein the base includes a canted surface portion transverse to the opening, the canted surface functions as a physical stop and seal between an underside of the lever pour spout end and canted surface such that as the cover moves upward and the lever pour spout pivots and cooperatively moves therewith, the pivotal movement of the lever is limited to an acute angle determined by the canted surface.

18. A reclosable package fitment of claim 17 wherein the angle is approximately 60 degrees in the open position to thereby allow the lever pour spout end to extend upward and away from the base such that when a container provided with the fitment is opened and tilted to pour contents from the container, the contents pass through the opening in the base along the pour spout channel in a continuous stream away from the container.

19. The reclosable package fitment of claim 14 wherein the cover is hinged to the base at a rear of the base proximate the puncturing end of the lever.

20. The reclosable fitment of claim 14 wherein the base includes a tamper evident element that cooperates with a frangible portion of the cover so that the frangible portion of the cover is broken when the cover is opened.

21. The reclosable package fitment of claim 14 wherein the pivotable attachment between the base and lever comprises pivot arms fitted within sockets to pivotally attach the lever to the base.

22. A reclosable package fitment comprising:

a base adapted to be attached to a container, the base including an opening therethrough;

a lever recessed within the opening and pivotally attached to the base intermediate a lever lifting end and a lever puncturing end;

a cover attached to the base independently of the lever, the cover being hinged to the base such that a lifting force directed against an underside of the lever at the lever lifting end causes the lever lifting end to be raised above the base to an open position and the lever to pivot relative to the base which causes the lever puncturing end to engage and puncture the container to thereby open the container and cause the cover to hinge away from the base and thereby prevent possible finger intrusion into the container during he opening of the fitment cover.

* * * * *